US006298870B1

(12) United States Patent
Ohtsuka et al.

(10) Patent No.: US 6,298,870 B1
(45) Date of Patent: Oct. 9, 2001

(54) VACUUM-OPERATED SEWAGE SYSTEM AND AIR INLET VALVE

(75) Inventors: Tetsushi Ohtsuka, Saitama; Tomohiro Nakamura, Shiga, both of (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

(21) Appl. No.: 09/462,203

(22) PCT Filed: Apr. 30, 1999

(86) PCT No.: PCT/JP99/02364

§ 371 Date: Jan. 4, 2000

§ 102(e) Date: Jan. 4, 2000

(87) PCT Pub. No.: WO99/57386

PCT Pub. Date: Nov. 11, 1999

(30) Foreign Application Priority Data

| | | |
|---|---|---|
| May 6, 1998 | (JP) | 10-123620 |
| Sep. 1, 1998 | (JP) | 10-247125 |
| Feb. 10, 1999 | (JP) | 11-032959 |

(51) Int. Cl.[7] ..... F04F 3/00
(52) U.S. Cl. ..... 137/205; 137/236.1
(58) Field of Search ..... 137/205, 236.1

(56) References Cited

FOREIGN PATENT DOCUMENTS

| | | |
|---|---|---|
| 94 03 578 | 6/1994 | (DE) . |
| 0 258 525 | 3/1988 | (EP) . |
| 197376 | 1/1990 | (HU) . |
| 202606 | 9/1990 | (HU) . |
| 202605 | 10/1990 | (HU) . |
| 203908 | 10/1991 | (HU) . |
| 1578 | 8/1999 | (HU) . |
| 8-319662 | 12/1996 | (JP) . |

*Primary Examiner*—Gerald A. Michalsky
(74) *Attorney, Agent, or Firm*—Armstrong, Westerman, Hattori, McLeland & Naughton, LLP

(57) ABSTRACT

In a vacuum-operated sewage system, a vacuum sewage pipe (31) evacuated inside to a vacuum state is connected to a sewage suction pipe (15) via a vacuum valve (14) operated by the vacuum in the vacuum sewage pipe (31). While the vacuum valve (14) is open, sewage accumulated in a sewage tank (11) is sucked through the sewage suction pipe (15) into the vacuum sewage pipe (31). An air inlet valve (20) is connected in the neighborhood of the vacuum valve (14) and between the vacuum valve (14) and the vacuum sewage pipe (31), and operated by the vacuum in the vacuum sewage pipe (31). When the degree of vacuum drops in the vacuum sewage pipe (31), the air inlet valve (20) is allowed to open and supply air into the vacuum sewage pipe (31).

7 Claims, 13 Drawing Sheets

VACUUM-OPERATED SEWAGE SYSTEM AND AIR INLET VALVE

TECHNICAL FIELD

The present invention relates to a vacuum-operated sewage system for transporting sewage by means of the vacuum, and an air inlet valve used in the vacuum-operated sewage system.

BACKGROUND ART

Vacuum-operated sewage systems have been developed for vacuum-transportation and collection of sewage discharged from houses and the like. A conventional vacuum-operated sewage system is comprised of a vacuum valve unit including a sewage tank for accumulation of sewage discharged from houses and the like, a water tank located in the vacuum station for collection of the sewage, and a vacuum sewage pipe connecting the vacuum valve unit and the water tank. A vacuum pump is installed in the vacuum station and evacuates the inside of the vacuum sewage pipe.

The vacuum valve unit includes a sewage suction pipe for sucking sewage accumulated under atmospheric pressure in the sewage tank, and a vacuum valve for communication and shut-off between the sewage suction pipe and the vacuum sewage pipe. The opening and closure of the vacuum valve is controlled by making the vacuum sewage pipe vacuous. While the vacuum valve is open, communication between the vacuum sewage pipe and the sewage suction pipe is established to allow the suction of the sewage accumulated in the sewage tank into the evacuated vacuum sewage pipe.

The vacuum sewage pipe is designed either to suck air after the suction of sewage or to suck air and sewage together. The sucked air flows faster in the vacuum sewage pipe than the sewage, which creates a two-phase flow of sewage and air in the vacuum sewage pipe. The two-phase air/liquid flow travels at a high speed and transports the sewage through the vacuum sewage pipe.

While the non-vacuum sewage pipe should be laid inclined in one direction and depend on natural downflow of sewage, the vacuum sewage pipe is usually buried in a shallow ground closer to the ground surface, in a serrated plumbing pattern comprising alternate repetition of downward slopes and upward slopes (lift parts) with a height difference of about 30 cm. Where the course of the vacuum sewage pipe between the vacuum valve unit and the vacuum station is interrupted by obstructions such as a river and other subterranean pipes, the vacuum sewage pipe is arranged to make a detour over or under the obstructions.

In the vacuum sewage pipe of this plumbing pattern, the air travels at a high speed and flows ahead of the sewage in the presence of the two-phase air/liquid flow. The sewage left behind the air remains stagnant at the bottom of a lift part to form a water-seal which seals the sewage pipe. The water-seal sewage at the bottom of the lift part passes the lift part by forming a two-phase air/liquid flow together with another flow of air sucked from the upstream side of the water-seal. The sewage which has passed through the lift part is then trapped at the bottom of the next lift part to form another water-seal. Thus, in the vacuum sewage pipe, sewage is transported beyond the lift parts to the water tank in the vacuum station, with repeating the formations of the two-phase air/liquid flow and the water-seal. The sewage collected in the water tank is then sent pressurised to a sewage treatment plant or the like by means of a pressure pump.

The vacuum-operated sewage system can be classified into a separate air/liquid suction method of sucking the sewage from the sewage tank into the vacuum sewage pipe and sucking the air thereafter (see Japanese Patent Application Laid-open No. 43527/1991 (JP-A-3-43527)), or a simultaneous air/liquid suction method of sucking the sewage and air at the same time (see Japanese Patent Application Laid-open No. 33380/1993 (JP-A-5-33380)). The simultaneous air/liquid suction method also includes the simultaneous-separate air/liquid suction method which independently sucks supplementary air, following the simultaneous air/sewage suction step, so as to compensate for the amount of sucked air.

In any of these methods, sewage and air are sucked into the vacuum sewage pipe normally at a ratio of about 1:3. For example, 40 litres of sewage basically requires 120 litres of air. The sewage/air ratio can be judiciously adjusted for every vacuum valve unit where the sewage and air are sucked off, depending on such conditions as the degree of vacuum obtained in the sewage tank and the plumbing pattern of the vacuum sewage pipe.

The separate air/liquid suction method comprises alternate steps of sucking sewage from a sewage suction pipe and then sucking air from the same sewage suction pipe, whereby a flow of the sucked air transports the sewage efficiently. The amount of the air suction can be controlled by adjusting the air suction time.

According to the simultaneous air/liquid suction method, the vacuum valve unit further includes, besides a sewage suction pipe for sucking sewage, an air suction pipe having a smaller diameter than the sewage suction pipe and disposed downstream of the vacuum valve. Air is sucked from the air suction pipe, while the sewage is sucked from the sewage suction pipe.

In these conventional methods, the ratio of air and sewage to be sucked into the vacuum sewage pipe is regulated at a relatively stable level. In practice, however, the operation of the vacuum-operated sewage system is affected by various causes including the case where the amount of sewage flowing into the vacuum valve unit is not constant throughout the day, the degree of vacuum in the vacuum sewage pipe varies due to the suction of sewage in the neighboring vacuum valve unit, or a two-phase air/liquid flow is not formed in the lift part of the large-diameter vacuum sewage pipe where air flows by itself. These conditions result in air shortage in creating a two-phase air/liquid flow which allows sewage to overflow the lift part, even if air is duly sucked in an amount preset for the clearance of a water-seal. In the end, sewage forms a water-block which completely blocks the lift part. Since the vacuum sewage pipe includes a number of lift parts, the water block may occur suddenly. Once the water-block stops up a lift part completely, the vacuum-operated sewage system is less likely to ensure stable transportation of sewage.

Some causes of the air shortage can be mentioned here. The simultaneous air/liquid suction method employs an air suction pipe of relatively small diameter located downstream of the vacuum valve. According to this structure, the air suction time is limited to the period when the vacuum valve is open. Besides, considering the amount of air intake depends on the diameter of the air suction pipe, the small-diameter suction pipe cannot supply a sufficient amount of air into the vacuum sewage pipe.

On the other hand, the separate air/liquid separation method controls the air suction time and amount into the vacuum sewage pipe by providing a controller or timer on the vacuum valve to control the time of opening the vacuum valve which effects communication and shut-off between the vacuum sewage pipe and the sewage suction pipe. Despite judicious control of the valve opening time, the ratio of air and sewage cannot be maintained in some cases. For example, if the degree of vacuum drops extremely within the vacuum sewage pipe, the vacuum valve, which opens and closes in accordance with the vacuum within the vacuum sewage pipe, may fail to operate properly. As a result, the air intake decreases relative to the sewage intake.

When the vacuum in the vacuum sewage pipe is at an extremely low degree, air needs to be sucked in an increased amount while the vacuum valve is open. By way of example, the separate air/liquid suction method additionally adopts a simultaneous air/liquid suction method of sucking sewage and air together to complement air into the vacuum sewage pipe. However, as described above, according to the simultaneous air/liquid suction method, air is sucked in a limited amount through the relatively small-diameter air suction pipe only when the vacuum valve is open. Thus, the air shortage problem in the vacuum sewage pipe cannot be solved simply by adopting the simultaneous air/liquid suction method.

Alternatively, in the separate air/liquid suction method, the vacuum valve unit can be designed to detect the completion of the sewage suction and the start of the air suction in the sewage tank, thereby to close the vacuum valve after a predetermined period of the air suction. This solution still fails to ensure sufficient air supply into the vacuum sewage pipe, in case the vacuum in the vacuum sewage pipe is at an extremely low degree.

Japanese Patent Application Laid-open No. 319662/1996 (JP-A-8-319662) discloses a vacuum-operated sewage system comprising a plurality of air intake ducts each connected to the upstream side neighboring the lift part in the vacuum sewage pipe, the top end of each air intake duct being located at the ground surface and provided with an air inlet valve. The air inlet valve is allowed to open when a water-block formed at the bottommost portion of the lift part causes the drop of the degree of vacuum in the vacuum sewage pipe on the upstream side thereof. Air on the ground is introduced through the open air inlet valve into the vacuum sewage pipe and eventually clears the water-block formed therein.

The air inlet valve provided at the top end of the air intake duct has a simple structure comprising a cylindrical housing which covers the top end of the air intake duct, and a valve member disposed opposite to the top end surface of the air intake duct and held inside the housing by a compression spring equipped therein. When the vacuum is created in the air intake duct which communicates with the vacuum sewage pipe, the valve member is sucked against the spring stress of the compression spring to close the top surface of the air intake duct. On the other hand, when the degree of vacuum drops in the air intake duct, the valve member opens the top surface of the air intake duct under the spring stress of the compression spring.

Nevertheless, the structure of the air inlet valve is too simple to operate the opening and closure thereof sensitively in response to the drop of the vacuum within the vacuum sewage pipe. In the end, the air inlet valve may fail to permit a quick and sufficient air supply into the vacuum sewage pipe.

As mentioned above, this sewage system provides a plurality of air inlet valves each at the top end of a plurality of air intake ducts connected to the vacuum sewage pipe. In case the pressure inside the vacuum sewage pipe is released to the atmosphere for such troubles as breakage of the vacuum sewage pipe, all of the air inlet valves are allowed to open. Following the recovery from the trouble (e.g. by repairing the vacuum sewage pipe), the inside pressure of the vacuum sewage pipe needs to be brought back to the normal vacuum state. However, it is difficult to evacuate the entire range of the vacuum sewage pipe, with all air inlet valves remaining open to the atmosphere.

This problem can be solved by providing a switch valve to every air inlet valve and operating the switch valve to the closed position. However, considering the extensive distribution of a number of switch valves, it is laborious to close all of them.

DISCLOSURE OF THE INVENTION

In order to solve the above-mentioned problems, the present invention aims to provide a vacuum-operated sewage system which effects a sufficient and guaranteed supply of air in correspondence with the degree of vacuum in the vacuum sewage pipe, and an air inlet valve used in the vacuum-operated sewage system.

Another object of the present invention is to provide a vacuum-operated sewage system which quickly recovers a normal vacuum state in the vacuum sewage pipe after the degree of vacuum has dropped therein, and an air inlet valve used in the vacuum-operated sewage system.

A vacuum operated sewage system of the present invention comprises a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open. This vacuum operated sewage system is characterized in that an air inlet valve connected in the neighborhood of the vacuum valve and between the vacuum valve and the vacuum sewage pipe is allowed to close by the vacuum in the vacuum sewage pipe, and to open and supply air into the vacuum sewage pipe when a degree of vacuum drops therein.

The air inlet valve employed in this vacuum-operated sewage system comprises a valve box having an air passage for passing the air, a diaphragm attached to the valve box and sucked therein by the vacuum in the vacuum sewage pipe, a valve member disposed in the valve box and allowed by the diaphragm sucked into the valve box to close the air passage, and a stressing means for stressing the valve member to open the air passage.

In the air inlet valve employed in this vacuum-operated sewage system, a force of the stressing means is adjustable.

In the air inlet valve employed in this vacuum-operated sewage system, displacement of the valve member is controlled when the degree of vacuum in the vacuum sewage pipe drops as far as a predetermined degree.

According to the vacuum-operated sewage system of the invention, the valve member provided in the air inlet valve closes the air passage when the degree of vacuum in the vacuum sewage pipe drops as far as a predetermined degree.

The valve member provided in the air inlet valve maximises an amount of air flowing through the air passage immediately after the air passage is opened, gradually decreases the amount of air flowing through the air passage in correspondence with a drop of the degree of vacuum in the vacuum sewage pipe, and closes the air passage when the degree of vacuum in the vacuum sewage pipe drops as far as a predetermined degree.

Alternatively, the valve member provided in the air inlet valve gradually increases the amount of air flowing through the air passage in correspondence with a drop of the degree of vacuum in the vacuum sewage pipe, and closes the air passage when the degree of vacuum in the vacuum sewage pipe drops as far as a predetermined degree.

The air inlet valve employed in this vacuum-operated sewage system comprises a valve box having an air passage for passing the air, a valve member displaceable in the valve box to open and close the air passage, a piston member being integrated with the valve member and displaceable in directions of opening and closing the air passage by the vacuum in the vacuum sewage pipe, and a stressing means for stressing the piston member such that the valve member opens the air passage.

In the air inlet valve employed in this vacuum-operated sewage system, displacement of the valve member is controlled when the degree of vacuum in the vacuum sewage pipe drops as far as a predetermined degree.

Moreover, a vacuum-operated sewage system of the present invention transports sewage in the form of a two-phase air/liquid flow comprising air and sewage which flows through a vacuum sewage pipe evacuated inside to a vacuum state. The vacuum-operated sewage system includes an air inlet valve which is disposed in the neighborhood of an upstream of a potential water-block formation area in the vacuum sewage pipe so as to supply air from above the ground to the area. The air inlet valve comprises a valve box having an air passage for passing the air, a diaphragm attached to the valve box and sucked therein by the vacuum in the vacuum sewage pipe, a valve member disposed in the valve box and allowed by the diaphragm sucked into the valve box to close the air passage, and a stressing means for stressing the valve member to open the air passage.

Further, a vacuum-operated sewage system of the present invention transports sewage in the form of a two-phase air/liquid flow comprising air and sewage which flows through a vacuum sewage pipe evacuated inside to a vacuum state. The vacuum-operated sewage system includes a first air inlet valve which is disposed in the neighborhood of and upstream of a potential water-block formation area in the vacuum sewage pipe so as to supply air from above the ground to the area, and which is allowed to open when a degree of vacuum drops in the vacuum sewage pipe. The vacuum-operated sewage system is characterized in further comprising a second air inlet valve which is connected to the first air inlet valve and subjected to a pressure inside the vacuum sewage pipe transmitted through the first air inlet valve in an open state. The second air inlet valve is allowed to open when a degree of vacuum drops in the vacuum sewage pipe thereby to supply air thereto via the first air inlet valve, and allowed to close when the degree of vacuum in the vacuum sewage pipe drops as far as a predetermined degree.

In another aspect, the present invention provides an air inlet valve which is employed in a vacuum-operated sewage system comprising a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open. The air inlet valve is disposed in the neighborhood of the vacuum valve and between the vacuum valve and the vacuum sewage pipe, and allowed to close by the vacuum in the vacuum sewage pipe and to open and supply air into the vacuum sewage pipe when a degree of vacuum drops therein. The air inlet valve comprises: a valve box having an air passage for passing the air; a diaphragm attached to the valve box and sucked therein by the vacuum in the vacuum sewage pipe; a valve member disposed in the valve box and allowed by the diaphragm sucked into the valve box to close the air passage; and a stressing means for stressing the valve member to open the air passage.

In the air inlet valve, a force of the stressing means is adjustable.

In the air inlet valve, displacement of the valve member is controlled when the degree of vacuum in the vacuum sewage pipe drops as far as a predetermined degree.

In the air inlet valve, the valve member closes the air passage when the degree of vacuum in the vacuum sewage pipe drops as far as a predetermined degree.

In the air inlet valve, the valve member maximises an amount of air flowing through the air passage immediately after the air passage is opened, gradually decreases the amount of air flowing through the air passage in correspondence with a drop of the degree of vacuum in the vacuum sewage pipe, and closes the air passage when the degree of vacuum in the vacuum sewage pipe drops as far as a predetermined degree.

Alternatively, in the air inlet valve, the valve member gradually increases the amount of air flowing through the air passage in correspondence with a drop of the degree of vacuum in the vacuum sewage pipe, and closes the air passage when the degree of vacuum in the vacuum sewage pipe drops as far as a predetermined degree.

Moreover, the present invention provides an air inlet valve which is employed in a vacuum-operated sewage system comprising a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open. The air inlet valve is disposed in the neighborhood of the vacuum valve and between the vacuum valve and the vacuum sewage pipe, and allowed to close by the vacuum in the vacuum sewage pipe and to open and supply air into the vacuum sewage pipe when a degree of vacuum drops therein. The air inlet valve comprises: a valve box having an air passage for passing the air; a valve member displaceable in the valve box to open and close the air passage; a piston member being integrated with the valve member and displaceable in directions of opening and closing the air passage by the vacuum in the vacuum sewage pipe; and a stressing means for stressing the piston member such that the valve member opens the air passage.

In the air inlet valve, displacement of the valve member is controlled when the degree of vacuum in the vacuum sewage pipe drops as far as a predetermined degree.

Further, the present invention provides an air inlet valve which is employed in a vacuum-operated sewage system for transporting sewage in the form of a two-phase air/liquid flow comprising air and sewage which flows through a vacuum sewage pipe evacuated inside to a vacuum state. The air inlet valve is disposed in the neighborhood of, and upstream of, a potential water-block formation area in the vacuum sewage pipe so as to supply air from above the ground to the area. The air inlet valve comprises: a valve box having an air passage for passing the air; a diaphragm attached to the valve box and sucked therein by the vacuum in the vacuum sewage pipe; a valve member disposed in the valve box and allowed by the diaphragm sucked into the valve box to close the air passage; and a stressing means for stressing the valve member to open the air passage.

Still further, the present invention provides an air inlet valve which is employed as a second air inlet valve in a vacuum-operated sewage system for transporting sewage, with the use of two air inlet valves, in the form of a two-phase air/liquid flow comprising air and sewage which flows through a vacuum sewage pipe evacuated inside to a vacuum state. A first air inlet valve is disposed in the neighborhood of, and upstream of, a potential water-block formation area in the vacuum sewage pipe so as to supply air from above the ground to the area. A second air inlet valve is connected to the first air inlet valve and subjected to a pressure inside the vacuum sewage pipe transmitted through the first air inlet valve in an open state. The second air inlet valve is allowed to open when a degree of vacuum drops in the vacuum sewage pipe thereby to supply air thereto via the first air inlet valve, and allowed to close when the degree of vacuum in the vacuum sewage pipe drops as far as a predetermined degree. The second air inlet valve comprises: a valve box having an air passage for passing the air; a diaphragm attached to the valve box and sucked therein by the vacuum in the vacuum sewage pipe' a valve member disposed in the valve box and allowed by the diaphragm sucked into the valve box to open the air passage; and a stressing means for stressing the valve member to close the air passage.

BEST MODE FOR CARRYING OUT THE INVENTION

The embodiments of the present invention are hereinafter described with reference to the attached drawings.

Figure 1:
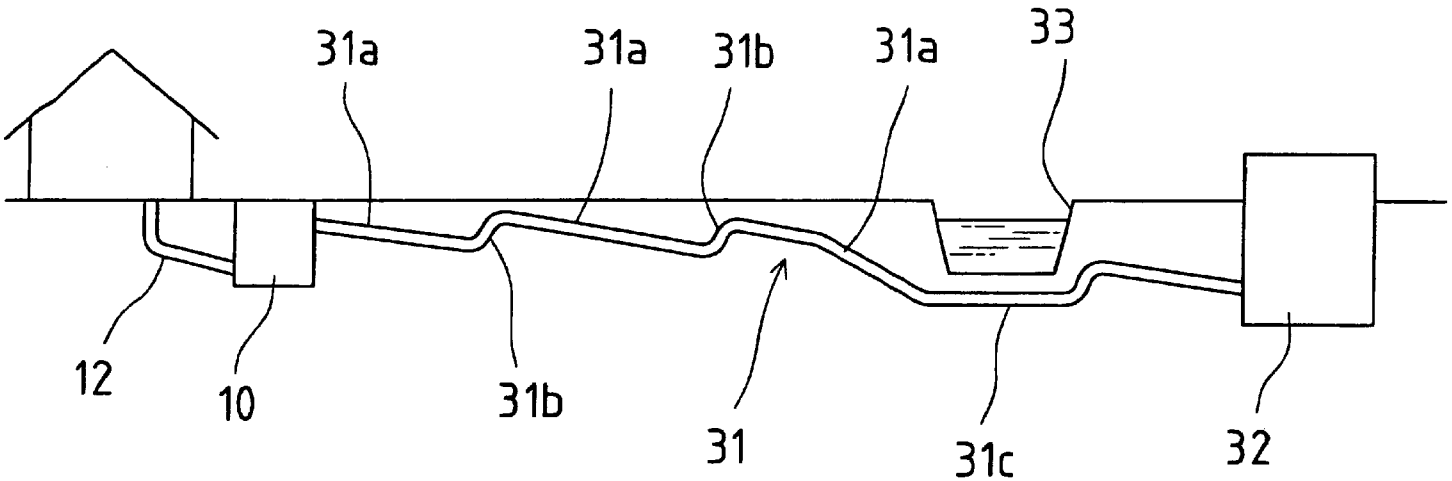
FIG. 1 is a schematic view showing one embodiment of the vacuum-operated sewage system of the present invention.

FIG. 1 schematically illustrates an embodiment of the vacuum-operated sewage system of the present invention. In this system, sewage drained from houses, factories, etc. flows naturally down in a sewage introduction pipe 12 to accumulate in a vacuum valve unit 10 buried underground. The sewage in the vacuum valve unit 10 is transported through a vacuum sewage pipe 31 and collected in a water tank disposed in a vacuum station 32. The vacuum valve unit 10 and the water tank in the vacuum station 32 are communicated through the vacuum sewage pipe 31 which is evacuated by means of a vacuum pump disposed in the vacuum station 32.

The vacuum sewage pipe 31 is buried in a relatively shallow ground close to the surface, and comprises alternate repetition of a downward slope 31*a* having a gentle downward gradient and an upward slope (lift part) 31*b* which follows the downstream end of the downward slope 31*a* and has an upward gradient with a height difference of about 30 cm. The vacuum sewage pipe 31 may be arranged to avoid an obstruction 33 such as a river or existing water pipes by providing a diversion 31*c* which passes over or under the obstruction 33.

Figure 2:
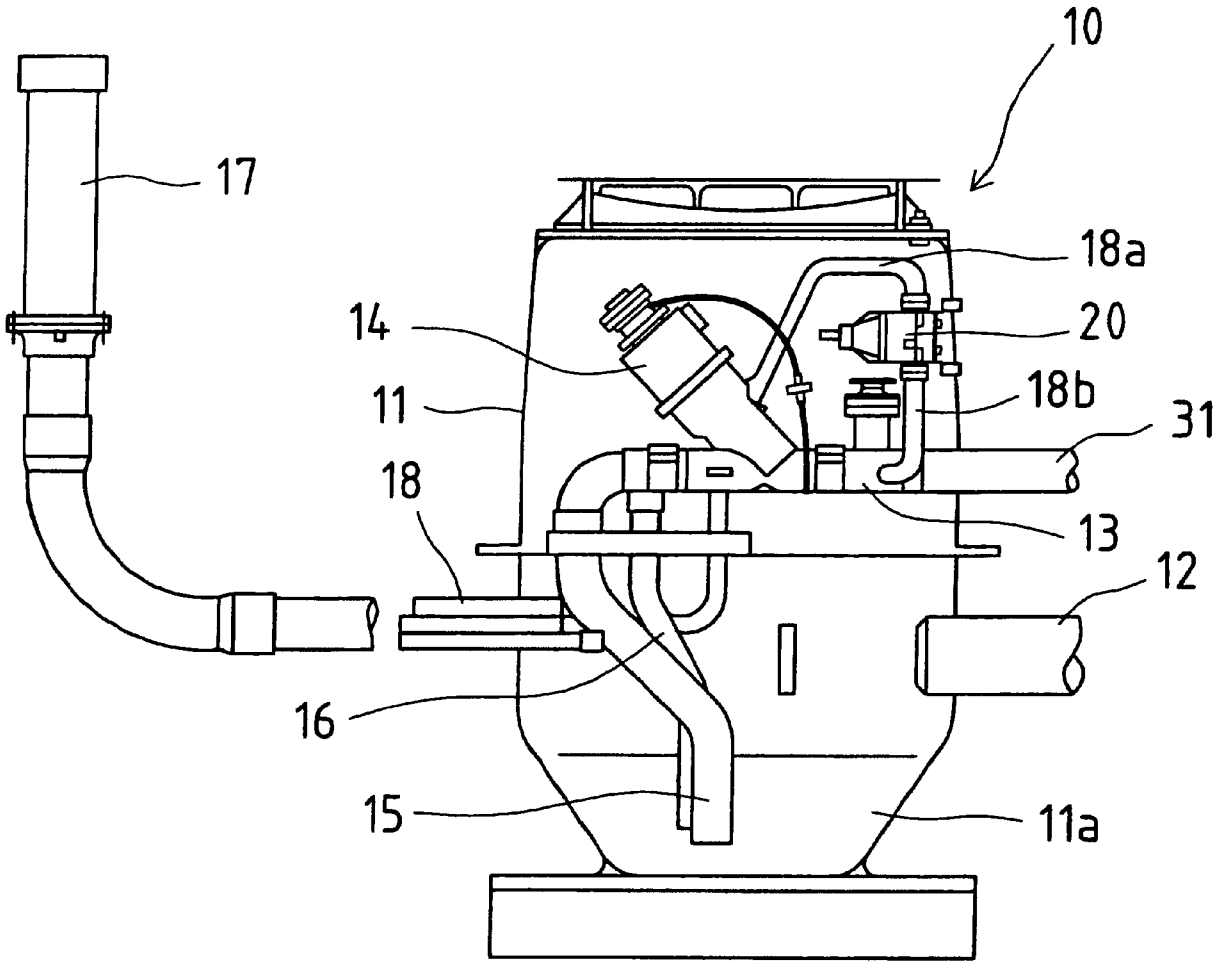
FIG. 2 is a sectional view showing a vacuum valve unit disposed in the vacuum-operated sewage system.

FIG. 2 schematically illustrates an embodiment of the vacuum valve unit 10 employed in the vacuum-operated sewage system. The vacuum valve unit 10 comprises a sewage tank 11 which is buried underground. The sewage tank 11 is usually made of a resin, but it may be also made of concrete. The lower part of the sewage tank 11 is joined with the bottom end of the sewage introduction pipe 12, whereby the sewage drained from houses, etc. naturally flows down the sewage introduction pipe 12 and accumulates in a sewage pool 11*a* at the bottom of the sewage tank 11. The upstream end of the vacuum sewage pipe 31 is inserted into the upper part of the sewage tank 11 in a substantially horizontal manner. Inside the sewage tank 11, the end of the vacuum sewage pipe 31 is joined with a gate valve 13. On the upstream side of the gate valve 13, the vacuum sewage pipe 31 is connected to a sewage suction pipe 15 via a vacuum valve 14. The sewage suction pipe 15 is bent downward to locate the bottom inlet thereof within the sewage pool 11*a* at the bottom of the sewage tank 11.

The gate valve 13 operates to shut off the communication of the vacuum sewage pipe 31 with the vacuum valve 14 and the sewage suction pipe 15, for example, during maintenance of the vacuum valve unit 10. For the operation of the vacuum-operated sewage system, the gate valve 13 is opened to allow communication between the vacuum sewage pipe 31 and the vacuum valve 14.

The vacuum valve 14 opens under the vacuum pressure in the vacuum sewage pipe 31 to establish communication between the vacuum sewage pipe 31 and the sewage suction pipe 15. When the sewage suction pipe 15 and the vacuum sewage pipe 31 are communicated by opening the vacuum valve 14, the degree of vacuum is equalised between the sewage suction pipe 15 and the vacuum sewage pipe 31. Thereby, the sewage in the sewage pool 11*a* is sucked into the sewage suction pipe 15 and supplied into the vacuum sewage pipe 31.

The sewage tank 11 includes a water level detection pipe 16 for detecting the level of sewage accumulated in the sewage pool 11*a*. The inside pressure of the water level detection pipe 16 rises in association with the rise of the sewage level in the sewage pool 11*a*. The opening and closure of the vacuum valve 14 is operated by the pressure obtained as the difference between the pressure inside the water level detection pipe 16 and the pressure inside the vacuum sewage pipe 31 which is connected via the gate valve 13 with the water level detection pipe 16 on the downstream side thereof. When the pressure in the water detection pipe 16 rises such that the pressure difference relative to the vacuum sewage pipe 31 exceeds a predetermined value, the vacuum valve 14 is opened by the vacuum inside the vacuum sewage pipe 31.

The sewage level in the sewage pool 11*a* drops down while the vacuum valve 14 is open. Provided that the sewage suction pipe 15 ceases to suck any more sewage, the vacuum valve 14 is controlled to close after the passage of a predetermined period. The time lag between the termination of the sewage suction and the closure of the vacuum valve 14 allows the sewage suction pipe 15 to suck up air in the sewage pool 11*a* for a suitable period of time after the suction of sewage therefrom.

An air intake duct 17 is connected to the sewage tank 11 above the sewage pool 11*a*. The air intake duct 17 is buried underground, with its top end upwardly projecting from the ground surface into the atmosphere. When the sewage or air in the sewage pool 11*a* is vacuum-sucked into the sewage suction pipe 15, the air intake duct 17 introduces the air from above the ground into the sewage pool 11*a* in order to prevent a pressure drop inside the sewage pool 11*a*.

The air intake duct 17 includes an air introduction pipe 18 for supplying the air in the air intake duct 17 directly into the vacuum sewage pipe 31 via an air inlet valve 20. Owing to the air introduction pipe 18, air is supplied from the air intake duct 17 into the vacuum sewage pipe 31 without fail, even when the sewage tank 11 in the vacuum valve unit 10 is flooded with water. However, where the sewage tank 11 may be or may not be flooded inside, the air in the sewage tank 11 can be directly supplied into the vacuum sewage pipe 31 by opening the air inlet valve 20 to the sewage tank 11.

Figure 3:
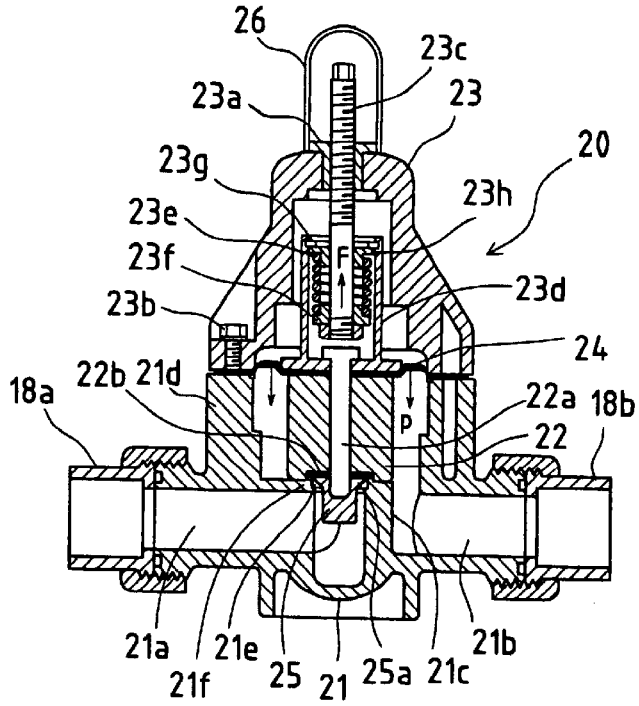
FIG. 3 is a sectional view showing an air inlet valve disposed in the vacuum valve unit.

FIG. 3 illustrates the air inlet valve 20 in section. The air inlet valve 20 comprises a valve box 21 coupled to the upstream portion 18*a* and the down-stream portion 18*b* of the air introduction pipe 18, a valve member 22 housed in the valve box 21, and a cap member 23 attached to the valve box 21. The downstream portion 18*b* of the air introduction pipe 18 is connected to the vacuum sewage pipe 31 via the gate valve 13.

The valve box 21 is of a cylindrical configuration and includes a cylindrical valve housing 21*d* which projects sideways from the axial center part thereof. In the valve box 21, one end defines a cylindrical air entrance 21*a* which is coupled with the upstream portion 18*a* of the air introduction pipe 18. The other end defines a cylindrical air exit 21*b* which is aligned with the air entrance 21*a* and coupled with the downstream portion 18*b* of the air introduction pipe 18. The valve housing 21*d* is disposed at a right angle with respect to the air entrance 21*a* and the air exit 21*b*, and communicates with the air exit 21*b*. The air entrance 21*a* is separated in the valve box 21 from the air exit 21*b* and the valve housing 21*d* by a partition 21*c*. The air entrance 21*a* is communicable with the valve housing 21*d* via an air passage 21*e* formed in the partition 21*c* concentrically with respect to the axis of the valve housing 21*d*.

The top opening of the valve housing 21*d* is airtightly covered by a diaphragm 24, on which a hollow frustoconical cap member 23 is secured integrally with the valve housing 21*d* by a bolt 23*b*. The cylindrical valve housing 21*d* includes the cylindrical valve member 22 which locates concentrically with the air passage 21*e* formed in the partition 21*c* and which is slidable away from the air passage 21*e*. The diaphragm 24 is made of a thermoplastic elastomer, or the like.

The outer diameter of the cap member 23 diminishes gradually toward its extreme end opposite to the valve housing 21*d*. A nut 23*a* is axially fitted in the extreme end of the cap member 23. An adjusting bolt 23*c* is screwed through the nut 23*a* and extends along the axis of the cap member 23 such that the head of the adjusting bolt 23*c* situates close to the valve housing 21*d*. The distal end, or the end opposite to the head, of the adjusting bolt 23*c* projects upwardly from the extreme end of the cap member 23, and the projecting portion is covered by a bolt cover 26 which is detachable from the cap member 23.

By operating the distal end projecting from the cap member 23, the adjusting bolt 23*c* is rotated forwardly or reversely and screwed with respect to the nut 23*a* fitted in the extreme end of the cap member 23. Thus, the adjusting bolt 23*c* is vertically displaced in the axial direction.

The shaft of the adjusting bolt 23*c* located within the cap member 23 is wrapped by a compression spring 23*e* which is held in compression by a lower spring holder 23*f* and an upper spring holder 23*h*. The lower spring holder 23*f* adjoins the head of the adjusting bolt 23*c*, while the upper spring holder 23*h* is slidably provided in the middle of the adjusting bolt 23*c* with a C-shaped snap ring 23*g* for preventing the release thereof.

The compression spring 23*c* is accommodated in a cylindrical piston 23*d* which is concentrically fitted with the adjusting bolt 23*c*. In the piston 23*d*, the top surface neighboring the nut 23*a* is engaged, via the C-shaped snap ring 23*g*, with the upper spring holder 23*h* which holds the top end of the compression spring 23*e*. Hence, the piston 23*d* is slidably held along the adjusting bolt 23*c* under the spring stress of the compression spring 23*e* stressing the piston 23*d* upwardly in the direction distant from the valve housing 21*d*.

Adjacent to the valve housing 21*d*, the bottom surface of the piston 23*d* axially holds the top end of a valve rod 22*a*. The valve rod 22*a* extends through the axial centers of the bottom surface of the piston 23*d*, the diaphragm 24, and the valve member 22 disposed in the valve housing 21*d*. The bottom end of the valve rod 22*a* is mounted with a guide member 25 via a packing 22*b* and concentrically inserted into the air passage 21*e* which provides communication between the valve housing 21*d* and the air entrance 21*a*.

The guide member 25 is inserted in the air passage 21*e* provided in the partition 21*c* of the valve box 21 and thus enters the air entrance 21*a*. The guide member 25, except the top end neighboring the valve member 22, is formed into a cylinder which is concentric to the valve rod 22*a* and the air passage 21*e* so as to provide a predetermined clearance with respect to the air passage 21*e*. The top end of the guide member 25 constitutes a frustoconical guide portion 25*a* whose outer diameter expands gradually toward the valve member 22.

A packing 22*b* is interposed between the valve member 22 and the guide member 25. The packing 22*b* is made of rubber or other elastic materials and shaped into a disc having an outer diameter slightly larger than that of the air passage 21*e* into which the guide member 25 is inserted. The packing 22*b* is fitted in, and pressed against, a recess formed in the center of the bottom surface of the valve member 22. The packing 22*b* is brought into airtight press-contact with the circumference of a valve seat 21*f* defining the periphery of the air passage 21*e*.

The guide member 25 is integrally mounted at the bottom end of the valve rod 22*a*, thus being united with the valve member 22 via the interposed packing 22*b*, with the top surface of the valve member 22 being pressed against the bottom surface of the piston 23*d* via the diaphragm 24. In other words, the piston 23*d* provided in the cap member 23 is integrated with the valve member 22 disposed in the valve housing 21*d*, via the diaphragm 24 interposed between the piston 23*d* and the valve member 22. Likewise, the valve member 22 and the guide member 25 are integrated together with the packing 22*b*.

When the piston 23*d* slides downwardly against the spring stress of the compression spring 23*e*, the guide member 25 slides down with the valve member 22. In this connection, the packing 22*b* interposed between the guide member 25 and the valve member 22 is pressed against the valve seat 21*f* defining the periphery of the air passage 21*e* to effect airtight closure of the air passage 21*e*. On the other hand, when the guide member 25 slides upwardly, the packing 22*b* is released from the press contact with the valve seat 21*f* to create a clearance between the inner circumferential surface of the air passage 21*e* and the outer circumferential surface of the guide member 25. This clearance provides communication between the air entrance 21*a* and the valve housing 21*d* in the valve box 21, and allows the vacuum sewage pipe 31 to communicate with the air intake duct 17 which introduces the air above the ground. As a result, the above-ground air is supplied through the air introduction pipe 18 and the air inlet valve 20 into the vacuum sewage pipe 31.

The vacuum-operated sewage system of this embodiment is operated in the open state of the gate valve 13 in the vacuum valve unit 10, in which state the inside of the vacuum sewage pipe 31 is evacuated by the vacuum pump disposed in the vacuum station.

Under the vacuum state of the vacuum sewage pipe 31, the degree of vacuum is equalised between the inside of the valve housing 21*d* in the air inlet valve 20 and the inside of the vacuum sewage pipe 31. Inside the evacuated air inlet valve 20, the diaphragm 24 providing an airtight separation between the valve housing 21*d* and the cap member 23 is subjected to a suction force P which acts inwardly of the valve housing 21*d*. When the suction force P exceeds the spring stress F of the compression spring 23*e* as adjusted by the adjusting bolt 23*c*, the diaphragm 24 is sucked inwardly of the valve housing 21*d* to cause the integrated downward slide of the piston 23*d*, the valve member 22 and the guide member 25. In the end, the packing 22*b* is pressed airtightly against the valve seat 21*f* to effect airtight closure of the air passage 21*e* which provides communication between the air entrance 21*a* and the valve housing 21*d* in the valve box 21.

When the sewage accumulated in the sewage pool 11*a* of the sewage tank 11 reaches a predetermined level as detected by the water level detection pipe 16, the vacuum valve 14 opens due to the vacuum of the vacuum sewage pipe 31. The opening of the vacuum valve 14 effects communication between the sewage suction pipe 15 and the vacuum sewage pipe 31 to equalise the degree of vacuum therebetween. As a result, the sewage accumulated in the sewage pool 11*a* is sucked up by the evacuated sewage suction pipe 15 into the vacuum sewage pipe 31. When the sewage level in the sewage pool 11*a* has dropped such that no more sewage is sucked from the sewage suction pipe 15, the sewage suction pipe 15 sucks the air in the sewage pool 11*a* instead. The vacuum valve 14 is closed after an appropriate period of air suction.

The thus sucked sewage and air flows through the vacuum sewage pipe 31 as a two-phase air/liquid flow. However, since the air flows faster than the sewage, the air alone passes the upward slope 31*b* of the vacuum sewage pipe 31, leaving the sewage at the bottommost portion thereof.

In the vacuum sewage pipe 31, the sewage remaining stagnant at the bottom of the upward slope 31*b* forms a water-seal which blocks only the lower part of the upward slope 31*b*. If the air shortage with respect to the sewage remains unsolved (e.g. the sewage supply exceeds the air supply), the sewage forms a water-block which completely blocks the whole of the upward slope 31*b*. The water-block formed in the vacuum sewage pipe 31 prevents the vacuum in the downstream side of the water-block from being transmitted to the upstream side, thus raising the pressure on the upstream side of the water-block. Consequently, the degree of vacuum in the vacuum sewage pipe 31 drops on the upstream side of the water-block.

Figure 4:
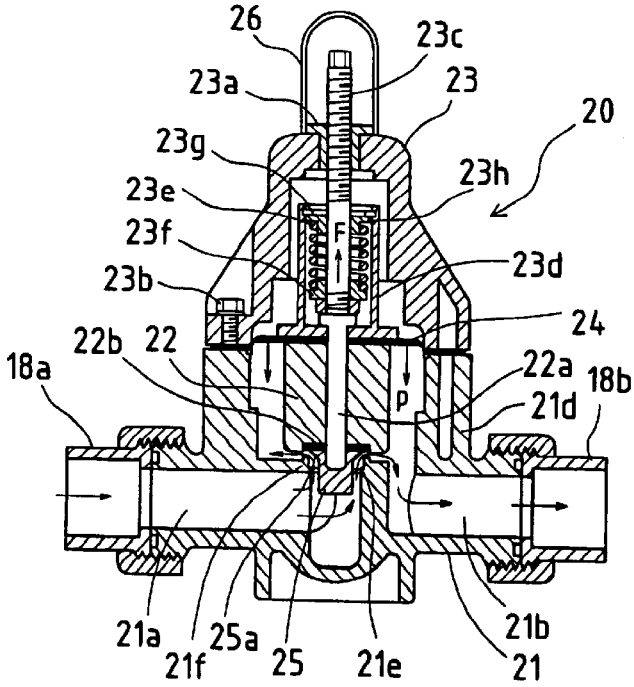
FIG. 4 is a sectional view showing the operation of the air inlet valve.

Meanwhile, in the vacuum valve unit 10, the degree of vacuum drops in the downstream portion 18*b* of the air introduction pipe 18 connected to the vacuum sewage pipe 31, and the degree of pressure rises in the air exit 21*b* and the valve housing 21*d* in the air inlet valve 20. When the suction force P on the diaphragm 24 becomes weaker than the spring stress F of the compression spring 23*e*, as shown in FIG. 4, the spring stress F of the compression spring 23*e* causes the piston 23*d* to slide upwardly together with the valve member 22 and the guide member 25 integrated therewith, including the packing 22*b* pressed against the valve seat 21*f* defining the periphery of the air passage 21*e* which provides communication between the air entrance 21*a* and the valve housing 21*d*. In the end, the air passage 21*e* is opened to establish communication between the air entrance 21*a* and the air exit 21*b* via the valve housing 21*d*.

At this moment, although the degree of vacuum has dropped in the air exit 21*b* as well as in the vacuum sewage pipe 31, the inside of the air exit 21*b* remains in a vacuum state with a pressure lower than the atmospheric pressure. Therefore, with the air passage 21*e* being open, the air above the ground is sucked into the air entrance 21*a* through the air intake duct 17 and the upstream portion 18*a* of the air introduction pipe 18. The air flowing into the air entrance 21*a* is led through the valve housing 21*d*, the air exit 21*b*, the downstream portion 18*b* of the air introduction pipe 18 and the gate valve 13 to be supplied into the vacuum sewage pipe 31.

In the presence of a water-block, air sucked into the vacuum sewage pipe 31 raises the pressure on the upstream side of the water-block and lowers the degree of vacuum therein. As long as the air passage 21*e* remains open, the pressure in the vacuum sewage pipe 31 continues to rise, until the air supplied therein breaks through the water-block. The sewage causing the water-block is accompanied by the rapidly flowing air to form a two-phase air/liquid flow, in which form the sewage passes the upward slope 31*b* in the vacuum sewage pipe 31.

Once the stagnant sewage flows away to clear the water-block, the degree of vacuum rises throughout the vacuum sewage pipe 31. When the suction force P imposed on the diaphragm 24 in the air inlet valve 20 becomes greater than the spring stress F of the compression spring 23*e,* the air passage 21*e* is closed.

Through the repetition of the above actions, the sewage is transported over one lift part after another by a two-phase air/liquid flow and finally collected in the water tank in the vacuum station 32.

According to the vacuum-operated sewage system of the invention, sewage and air is sucked into the vacuum sewage pipe 31 while the vacuum valve 14 is open. In addition, even after the closure of the vacuum valve 14, air is sufficiently supplied into the vacuum sewage pipe 31 by opening the air inlet valve 20 in accordance with the degree of vacuum in the vacuum sewage pipe 31. Therefore, there is created a two-phase air/liquid flow which is similar to the one formed in the simultaneous-separate air/liquid suction method. While the conventional sewage systems supply air into the vacuum sewage pipe in a predetermined and constant amount, the system of the present invention flexibly controls the air supply according to the changing degree of vacuum in the vacuum sewage pipe 31.

In the air inlet valve 20, as described above, the opening and closure of the air passage 21*e* is controlled by the vacuum in the vacuum sewage pipe 31. The degree of vacuum required therefor is adjusted by altering the spring stress F of the compression spring 23*e* with rotation of the adjusting bolt 23*c*. To be specific, the degree of vacuum in the vacuum sewage pipe 31, i.e. the suction force P applied to the diaphragm 24, required for closing the air passage 21*e* is increased by screwing the adjusting bolt 23*c* away from the air passage 21*e* and thus increasing the spring stress F of the compression spring 23*e*. On the other hand, the required degree of vacuum in the vacuum sewage pipe 31 is decreased by screwing the adjusting bolt 23*c* toward the air passage 21*e* and thus decreasing the spring stress F of the compression spring 23*e*.

Provided that the inside pressure of the vacuum sewage pipe 31 is set at −4.5 mAq, the air passage 21*e* in the air inlet valve 20 is usually adjusted to open at a pressure of about −3.0 mAq.

In this regard, there are some merits and demerits in setting the degree of vacuum required to open the air passage 21*e* at a low degree, in which case the difference between the required vacuum and the normal vacuum in the vacuum sewage pipe 31 is wide. On the disadvantageous side, it may take a long time after the breakthrough of the water-block to recover the normal degree of vacuum in the vacuum sewage pipe 31. On the advantageous side, the air passage 21*e* may be allowed to open at a low vacuum which fails to operate the vacuum valve, provided that the vacuum valve unit 10 is located at the upstream end of the vacuum sewage pipe 31 which has a long distance but a small number of upward slopes 31*b*. As a result, air is sucked into the vacuum sewage pipe 31 over a relatively long period of time, allowing the stagnant sewage to flow gently through the vacuum sewage pipe 31.

In contrast, when the air passage 21*e* is allowed to open at a high degree of vacuum, the difference between the required vacuum and the normal vacuum in the vacuum sewage pipe 31 being narrow, the air inlet valve 20 is allowed to open at a slight drop of the vacuum degree in the vacuum sewage pipe 31. Accordingly, at the start of the sewage suction from the sewage suction pipe 15 which takes place in association with the opening of the vacuum valve 14 of the vacuum valve unit 10, the drop of the vacuum degree in the vacuum sewage pipe 31 immediately causes the opening of the air passage 21*e* in the air inlet valve 20 and effects the suction of air into the vacuum sewage pipe 31. Consequently, the two-phase air/liquid flow is quickly formed at the start of the sewage suction and allows the sewage to flow through the vacuum sewage pipe 31 together with the thus sucked air. The method herein described can be classified into the simultaneous air/liquid suction method.

Figure 5:
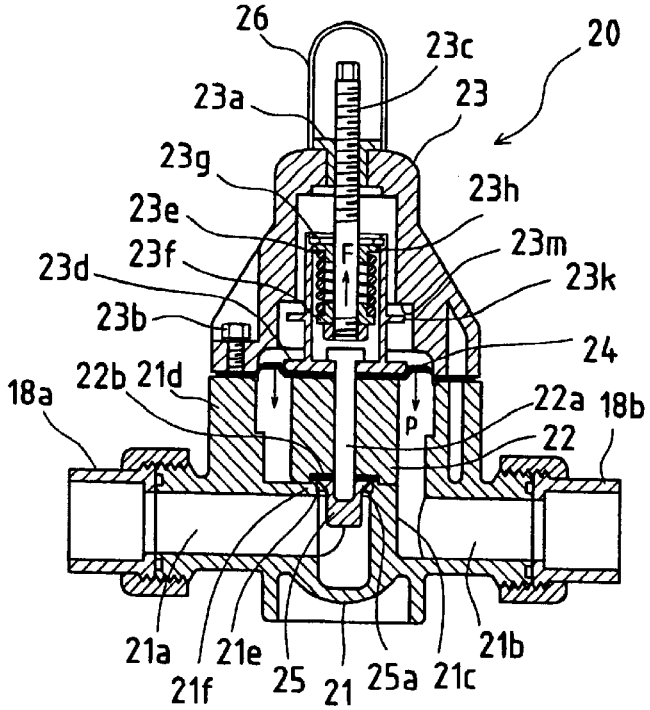
FIG. 5 is a sectional view showing a second air inlet valve disposed in the vacuum valve unit shown in FIG. 2.

FIG. 5 shows, in section, another embodiment the air inlet valve 20 arranged in the vacuum valve unit 10. The vacuum valve 20 has a stopper 23*k* which is provided at an intermediate position in the vertical direction of the piston 23*d* housed in the cap member 23. The stopper 23*k* has a rib configuration defined around a part or the whole of the outer circumference of the piston 23 and projects perpendicularly with respect to the axis thereof. The stopper 23*k* engages with a stage 23*m* formed along the inner circumferential surface of the cap member 23.

Figure 6:
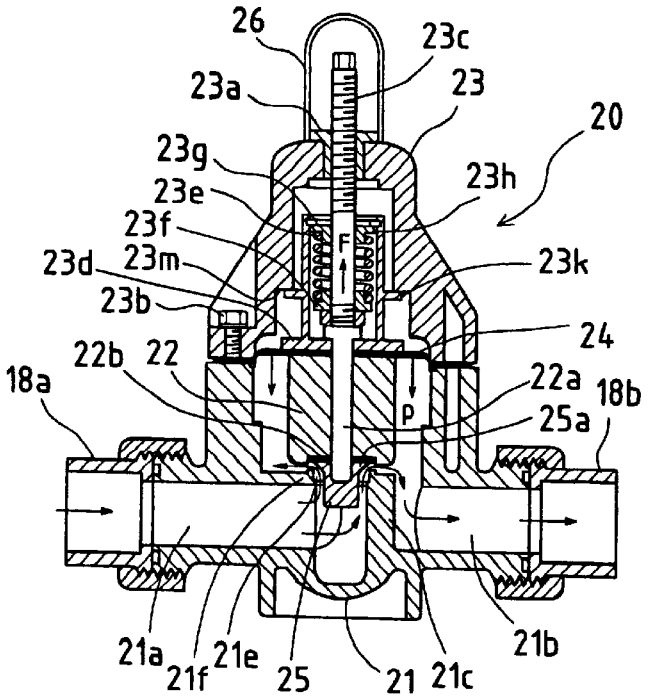
FIG. 6 is a sectional view showing the operation of the second air inlet valve.

In the second air inlet valve 20, when the inside pressure of the vacuum sewage pipe 31 increases to lower the degree of vacuum therein, in which case the spring stress F of the compression spring 23*e* becomes greater than the suction force P on the diaphragm 24, the spring stress F of the compression spring 23*e* allows the piston 23*d* to slide away from the air passage 21*e*. As shown in FIG. 6, when the piston 23*d* slides by a predetermined distance, the stopper 23*k* is checked at the stage 23*m* formed along the inner circumferential surface of the cap member 23 to stop the sliding movement of the piston 23*d*. The stopper 23*k* thus prevents excessive displacement of the piston 23*d* away from the air passage 21*e*. As a result, the air passage 21*e* can be closed quickly, when the degree of vacuum in the vacuum sewage pipe 31 reaches a predetermined degree and allows the piston 23*d* to slide toward the air passage 21*e*.

The stopper 23*k* and the stage 23*m* are positioned such that, once the air passage 21*e* opens, the amount of the air flow through the air passage 21*e* stays constant irrespective of any further sliding movement of the piston 23*d*. According to the specified positions of the stopper 23*k* and the stage 23*m,* when the tapered guide portion 25*a* provided at the top end of the guide member 25 leaves the air passage 21*e* and entirely enters the valve housing 21*d,* the sliding movement of the piston 23*d* is stopped with maintaining a predetermined clearance axially defined between the inner circumferential surface of the air passage 21*e* and the outer circumferential surface of the guide member 25.

As described above, the air passage 21*e* can be closed quickly by limiting the sliding movement of the piston 23*d,* which results in quick recovery of the normal vacuum state in the vacuum sewage pipe 31. In addition, the limited sliding movement reduces the amount of deformation in the diaphragm 24 and hence a load imposed thereon.

Figure 7:
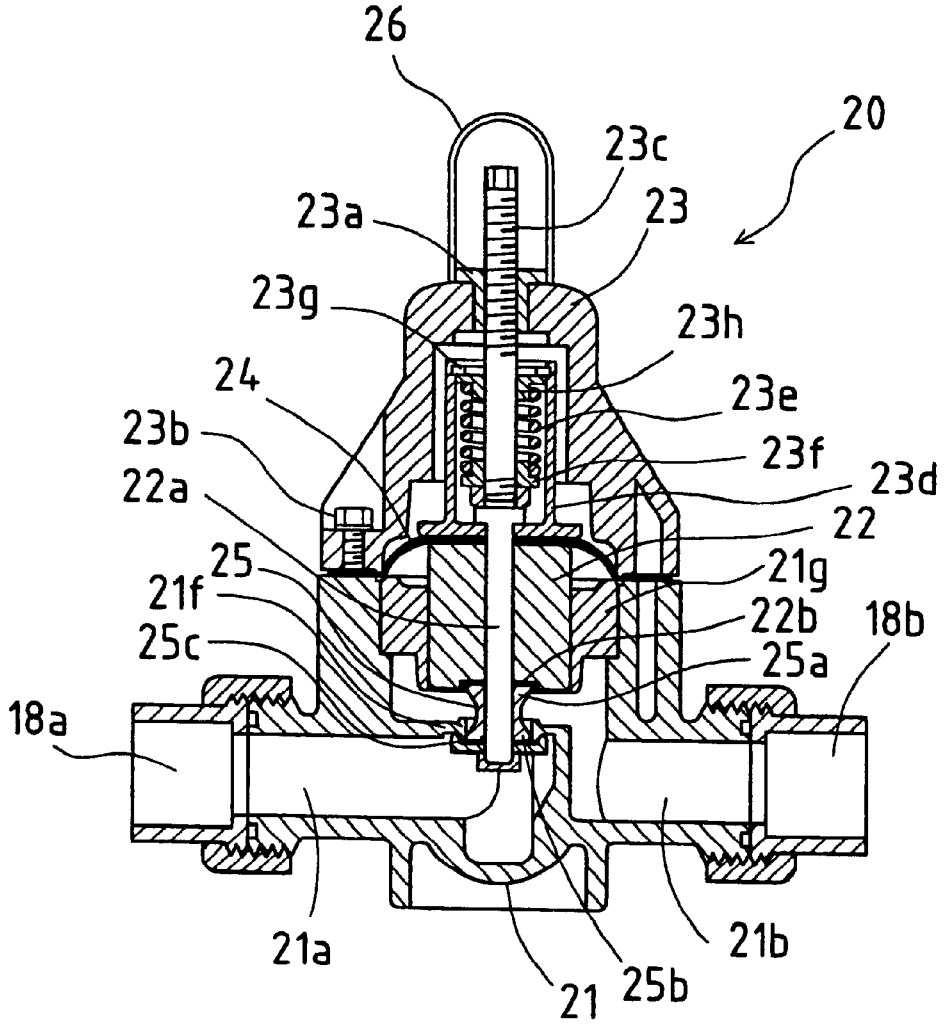
FIG. 7 is a sectional view showing a third air inlet valve disposed in the vacuum valve unit shown in FIG. 2.

FIG. 7 shows, in section, a yet another embodiment of the air inlet valve 20. In the third air inlet valve 20, the valve member 22 accommodated in the valve housing 21*d* of the valve box 21 is slidably held along the axial direction of the valve housing 21*d* by a valve guide 21*g* provided therein. The valve guide 21*g* permits an air flow in the axial direction. In another respect, the bottom end of the guide member 25, which advances into the air entrance 21*a* through the air passage 21*e* providing communication between the air entrance 21*a* and the valve housing 21*d,* is formed into a frustoconical guide portion 25*b* whose outer diameter expands gradually toward the bottom end of the guide member 25. The bottom surface of the guide portion 25*b* is equipped with a disc-shaped rubber packing 25*c* which closes the air passage 21*e* when pressed against the valve seat 21*f* formed at the periphery of the air passage 21*e* on the air entrance 21*a* side. Except these arrangements, the air inlet valves 20 shown in FIG. 7 and in FIGS. 5 and 6 have a similar structure.

Figure 8:
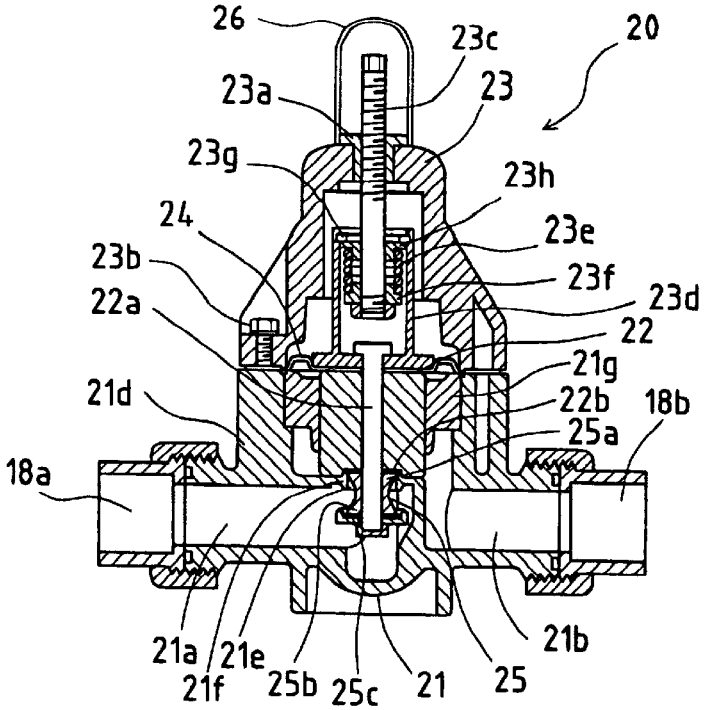
FIG. 8 is a sectional view showing the operation of the third air inlet valve.
Figure 9:
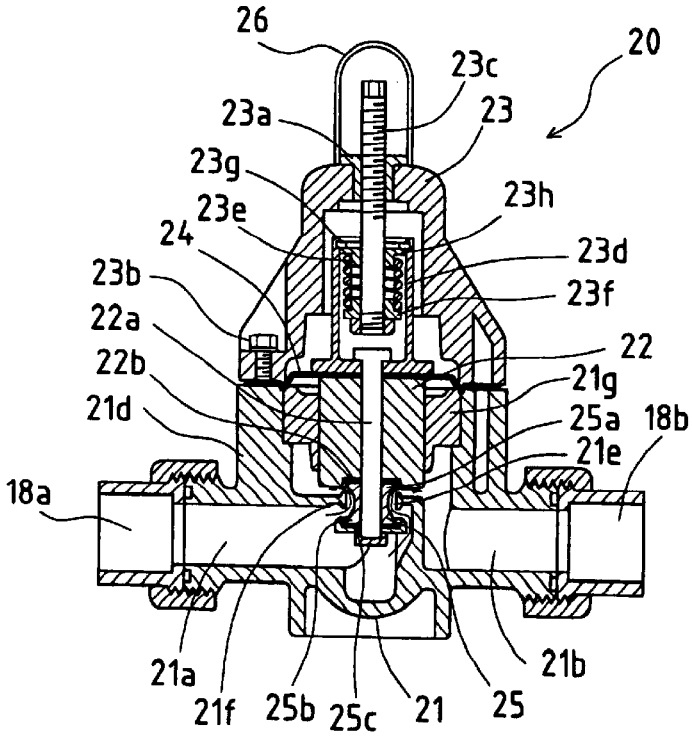
FIG. 9 is a sectional view showing the operation of the third air inlet valve.

In the third air inlet valve 20, the air passage 21*e* is normally closed by the vacuum inside the vacuum sewage pipe 31, as shown in FIG. 8 and described with regard to the preceding air inlet valves 20. When the pressure in the vacuum sewage pipe 31 rises due to a water-block formed by the sewage sucked into the vacuum sewage pipe 31, the spring stress F of the compression spring 23*e* allows the valve member 22 to slide away from the air passage 21*e* to effect the opening thereof, as shown in FIG. 9. The air passage 21*e* is closed after the water-block is cleared by the air supplied through the air inlet valve 20 into the vacuum sewage pipe 31.

The air passage 21*e* is also allowed to open when the degree of vacuum inside the vacuum sewage pipe 31 drops for other reasons than the water-block, including breakage of the vacuum sewage pipe 31 and failure of the vacuum valve 14. Through the air passage 21*e,* air is supplied into the vacuum sewage pipe 31 to raise the pressure and reduce the vacuum therein to a further degree. When the degree of vacuum in the vacuum sewage pipe 31 drops below a predetermined value, the packing 25*c* located inside the air entrance 21*a* of the valve box 21 is pressed against the valve seat 21*f* to close the air passage 21*e,* as shown in FIG. 7. Now that the air supply to the vacuum sewage pipe 31 is cut off, the degree of vacuum therein does not drop any further.

As described above, in case the degree of vacuum inside the vacuum sewage pipe 31 drops for a long period, not because of the water-block but because of such troubles as breakage of the vacuum sewage pipe 31 and failure of the vacuum valve 14, air is introduced into the vacuum sewage pipe 31 through the open air inlet valve 20. However, when the degree of vacuum in the vacuum sewage pipe 31 drops below a predetermined value, the air supply thereto is stopped by closing the air passage 21*e* of the air inlet valve 20 with the packing 25*c*. The air passage 21*e* is closed by the packing 25*c* usually when the pressure in the vacuum sewage pipe 31 almost reaches the atmospheric pressure.

Thus, the air inlet valve 20 is closed to stop the air supply to the vacuum sewage pipe 31, when the degree of vacuum inside the vacuum sewage pipe 31 drops below a predetermined value. In case the drop of the vacuum degree is caused by breakage of the vacuum sewage pipe 31 or the like, this structure minimises the damage to the vacuum-operated sewage system. After the trouble is solved, the vacuum sewage pipe 31, which has received no air supply as a result of the closure of the air inlet valve 20, can be quickly brought back to the normal vacuum condition.

Figure 10:
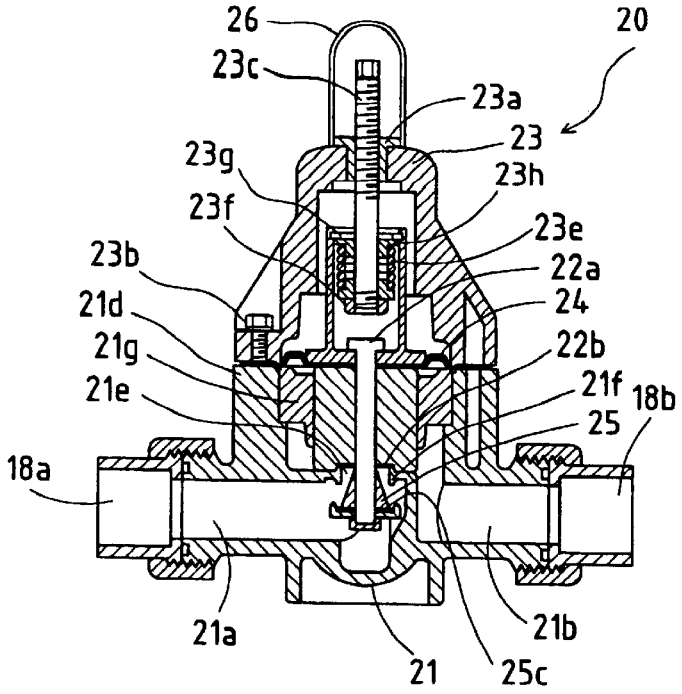
FIG. 10 is a sectional view showing a fourth air inlet valve disposed in the vacuum valve unit shown in FIG. 2.

FIG. 10 shows, in section, a still another embodiment of the air inlet valve 20. In the fourth air inlet valve 20, the guide member 25 disposed at the bottom end of the valve member 22 is shaped in the form of a cone with an outer diameter gradually diminishing toward the valve member 22. The bottom end surface of the guide member 25 is located inside the air entrance 21*a* of the valve box 21, and equipped with a packing 25*c* which closes the air passage 21*e* when pressed against the valve seat 21*f* formed at the air entrance 21*a*. Except these arrangements, the air inlet valves 20 shown in FIG. 10 and FIG. 7 have a similar structure.

In the fourth air inlet valve 20 shown in FIG. 10, the air passage 21*e* is normally closed as in the above-mentioned air inlet valves 20. While the vacuum in the vacuum sewage pipe 31 sucks the diaphragm 24, the valve member 22 slides toward the air passage 21*e* as guided by the valve guide 21*g,* whereby the packing 22*b* disposed between the valve member 22 and the guide member 25 is pressed against the valve seat 21*f* formed on the air entrance 21*a* side of the inner circumferential surface of the air passage 21*e*. When the pressure in the vacuum sewage pipe 31 rises due to a water-block formed by the sewage sucked from the sewage tank 11, the valve member 22 slides away from the air passage 21*e* as urged by the spring stress F of the compression spring 23*e*. Then, the packing 22*b* disposed between the valve member 22 and the guide member 25 loses contact with the valve seat 21*f* to open the air passage 21*e*.

Due to the tapered geometry of the guide member 25 characterised by its outer diameter gradually diminishing toward the valve member 22, the clearance formed between the inner circumferential surface of the air passage 21*e* and the outer circumferential surface of the guide member 25 has a sectional area which progressively increases toward the valve member 22. As a result, during the initial period of the opening of the air passage 21*e,* the clearance which serves an air route has a greater sectional area and permits a large quantity of air to flow through the air passage 21*e* into the valve housing 21*d,* the air being led through the air exit 21*b* and the downstream portion 18*b* of the air introduction pipe 18 and supplied into the vacuum sewage pipe 31. Namely, a large quantity of air can be supplied into the vacuum sewage pipe 31 in a short time after the air inlet valve 20 is opened. The thus supplied high-pressure air can break through the water-block formed in the vacuum sewage pipe 31 without fail.

Figure 11:
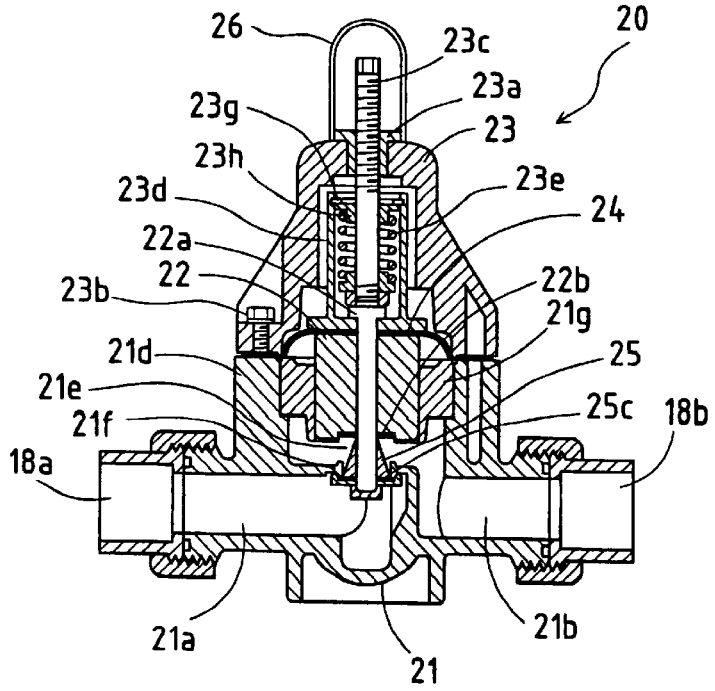
FIG. 11 is a sectional view showing the operation of the fourth air inlet valve.

In case the degree of vacuum in the vacuum sewage pipe 31 is decreased by a cause other than the water-block, air is supplied into the vacuum sewage pipe 31 through the air passage 21*e* opened in the air inlet valve 20. When the pressure in the vacuum sewage pipe 31 continues to rise and reduces the vacuum therein to a further degree, the guide member 25 slides in the air passage 21*e* toward the valve housing 21*d*. In this case, the air route clearance in the air passage 21*e* has a gradually diminishing sectional area and accordingly reduces the quantity of the air supply into the vacuum sewage pipe 31. If the pressure in the vacuum sewage pipe 31 nearly reaches the atmospheric pressure, the packing 25*c* provided at the bottom surface of the guide member 25 is pressed against the valve seat 21*f* to close the air passage 21*e,* as shown in FIG. 11. The closure of the air passage 21*e* stops the air supply into the vacuum sewage pipe 31 and prevents any further drop of the vacuum degree therein. Besides, with keeping the air passage 21*e* closed by the packing 25*c* at the bottom of the guide member 25, the inside of the vacuum sewage pipe 31 can be quickly brought back to the normal vacuum state.

Figure 12:
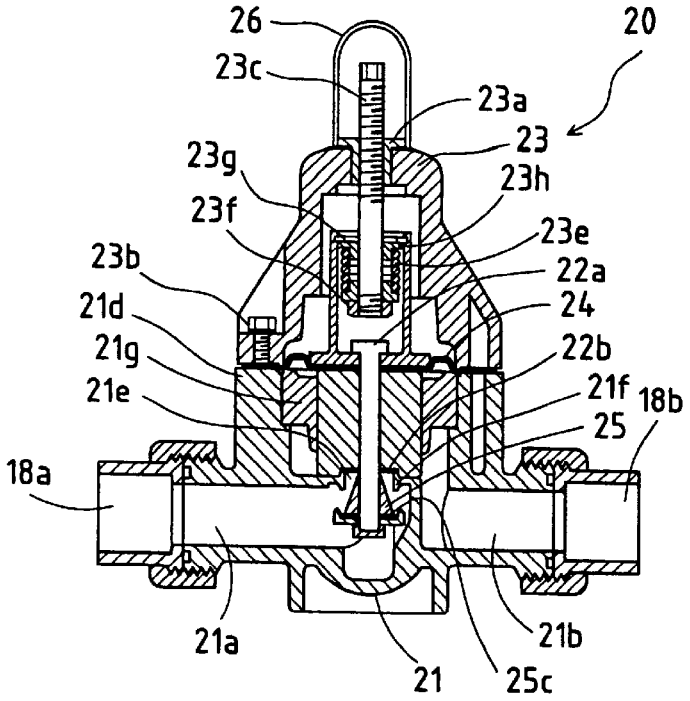
FIG. 12 is a sectional view showing a fifth inlet valve disposed in the vacuum valve unit shown in FIG. 2.
Figure 13:
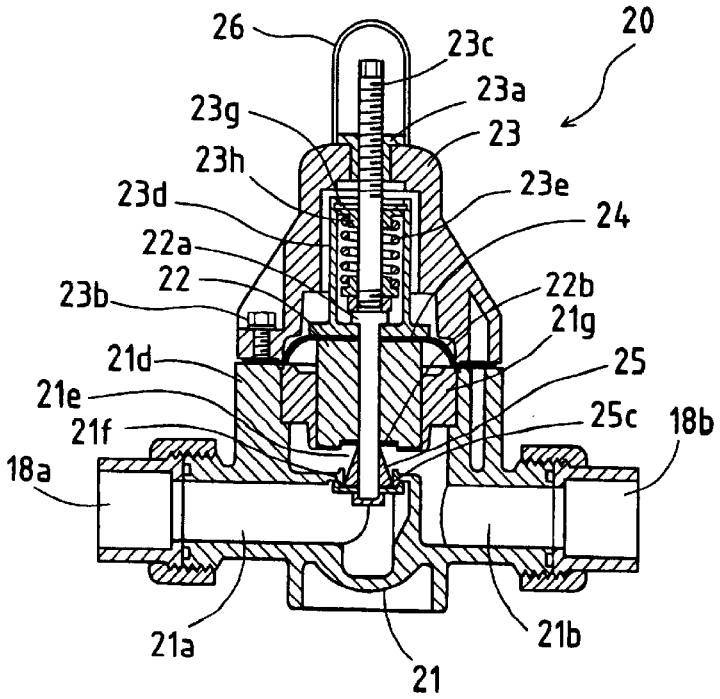
FIG. 13 is a sectional view showing the operation of the fifth air inlet valve.

As shown in FIG. 12, the guide member 25 inserted into the air passage 21*e* may be shaped in the form of a cone having an outer diameter gradually diminishing toward the air entrance 21*a* of the valve box 21. When the inside pressure of the vacuum sewage pipe 31 rises to reduce the degree of vacuum therein, the guide member 25 likewise slides inwardly of the valve housing 21 to open the air passage 21*e*. In the meantime, this embodiment is designed to gradually increase the amount of the air supplied through the air passage 21*e* to the vacuum sewage pipe 31 thereby to clear the water-block formed in the vacuum sewage pipe 31. After the breakthrough of the water-block, while the degree of vacuum is gradually recovered in the vacuum sewage pipe 31, the guide member 25 slides toward the air entrance 21*a* of the valve box 21, as shown in FIG. 13, to gradually diminish the sectional area of the air route clearance defined in the air passage 21*e*. When the vacuum sewage pipe 31 recovers a predetermined degree of vacuum, the air passage 21*e* is swiftly closed by the packing 22*b* pressed against it.

As described above, the air inlet valve 20 can be closed in a highly sensitive manner in response to the recovery of the predetermined vacuum degree in the vacuum sewage pipe 31, which recovery is required because air has been supplied into the vacuum sewage pipe 31 in relation to the drop of the vacuum degree therein. The air inlet valve 20 of the fifth embodiment is advantageously utilised in the vacuum valve unit 10 which locates distantly from the vacuum station, so that the predetermined degree of vacuum in the vacuum sewage pipe 31 can be quickly recovered in an area neighbouring the vacuum valve unit 10.

Figure 14:
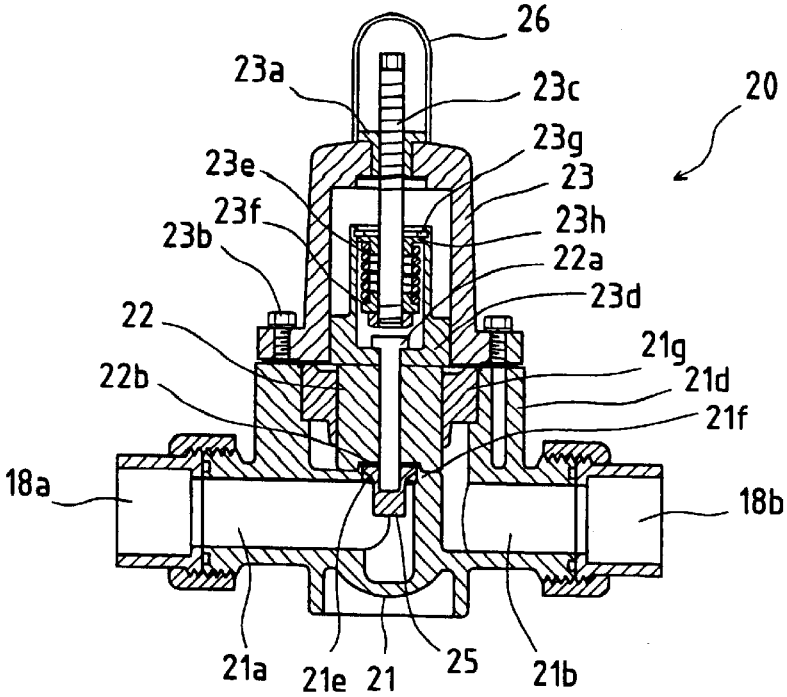
FIG. 14 is a sectional view showing a sixth air inlet valve disposed in the vacuum valve unit shown in FIG. 2.

FIG. 14 shows, in section, a yet further embodiment of the air inlet valve 20. In the sixth air inlet valve 20, the piston 23*d* arranged in the cap member 23 has an end portion of large diameter on the side close to the valve member 22, thereby to establish an airtight and slidable contact between the outer circumferential surface of the large-diameter end portion and the inner circumferential surface of the cap member 23. The piston 23*d* is directly integrally mounted on the valve member 22 provided in the valve housing 21*d* of the valve box 21, without interposition of the diaphragm 24. The valve member 22 is slidably held by the valve guide 21*g* which is provided inside the valve housing 21*d*. Except these arrangements, the air inlet valves 20 shown in FIG. 14 and FIG. 5 have a similar structure.

In the air inlet valve 20 of the sixth embodiment, the piston 23*d* is directly sucked toward the air passage 21*e* by the vacuum within the vacuum sewage pipe 31. Since the piston 23*d* is accommodated in the cap member 23 in an airtight and smoothly slidable manner, the valve member 22 integrated with the piston 23*d* slides smoothly toward the air passage 21*e* to effect the closure thereof.

Figure 15:
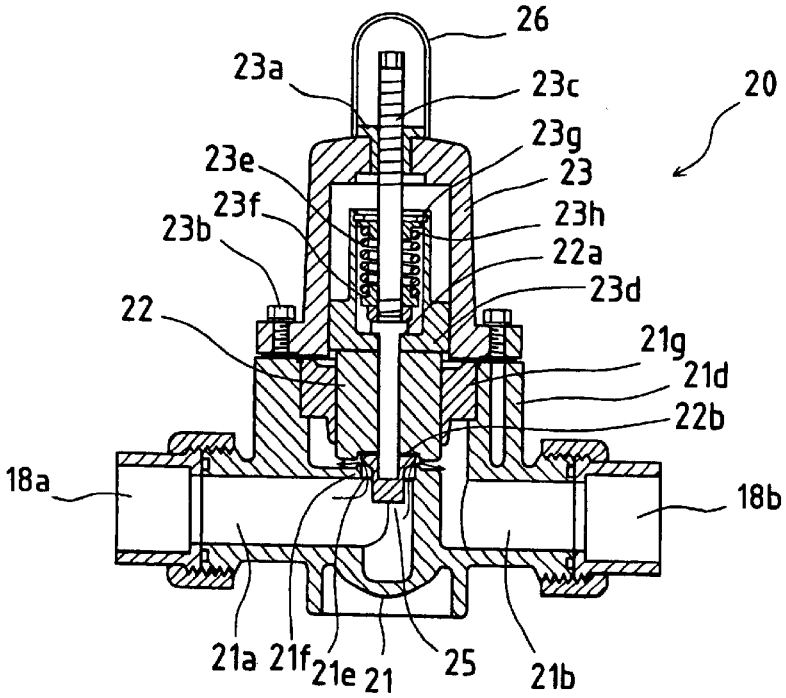
FIG. 15 is a sectional view showing the operation of the sixth air inlet valve.

When the degree of vacuum drops in the vacuum sewage pipe 31, the piston 23*d* slides smoothly away from the air passage 21*e* under the spring stress F of the compression spring 23*e*. The integrated valve member 22 slides smoothly in the same direction to open the air passage 21*e*, as shown in FIG. 15.

For airtight and smooth sliding movement of the piston 23*d* along the inner circumferential surface of the cap member 23, the large-diameter end portion of the piston 23*d* preferably has an outer circumferential surface made of a rubber, elastomer or the like. Alternatively, the inner circumferential surface of the cap member 23 may be made of a rubber, elastomer or the like.

The air inlet valve 20 of the sixth embodiment thus operates the piston 23*d* directly by the vacuum in the vacuum sewage pipe 31. Absence of a diaphragm enhances a pressure propagation efficiency in the vacuum sewage pipe 31. In addition, the air inlet valve 20 comprising a fewer components is not only economical but also easy to maintain.

Figure 16:
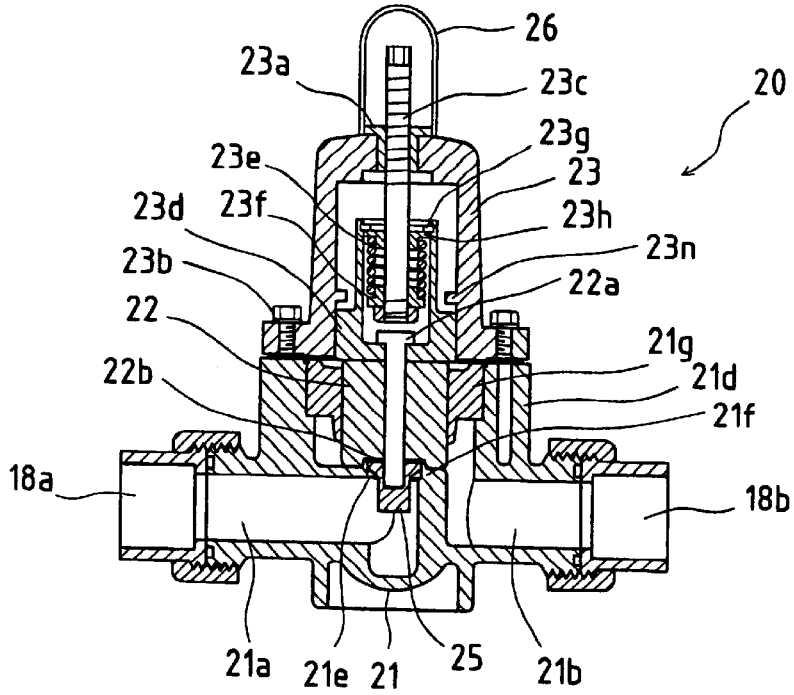
FIG. 16 is a sectional view showing a seventh air inlet valve disposed in the vacuum valve unit shown in FIG. 2.
Figure 17:
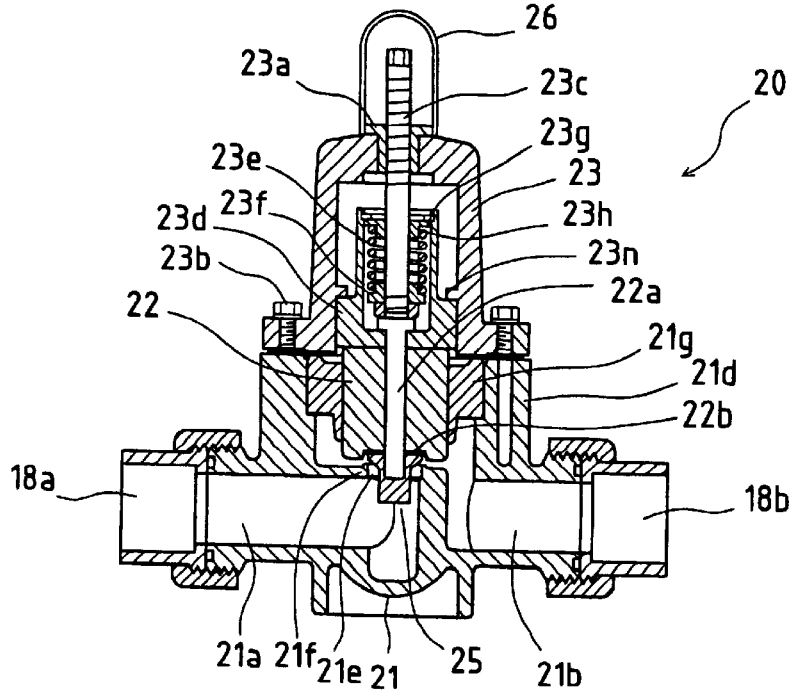
FIG. 17 is a sectional view showing the operation of the seventh air inlet valve.

As a variation of the sixth embodiment, the air inlet valve 20 may further comprise a stopper 23*n* formed on the inner circumferential surface of the cap member 23, as shown in FIGS. 16 and 17. The stopper 23*n* is designed to check the large-diameter end portion of the piston 23*d* and stop its sliding movement, when the piston 23*d* slides away from the air passage 21*e* by a predetermined distance under the spring stress F of the compression spring 23*e*.

The stopper 23*n* thus limits the distance of the sliding movement of the piston 23*d* which is effected in response to the opening of the air passage 21*e*. Consequently, the air passage 21*e* can be swiftly closed for quick recovery of the normal vacuum state in the vacuum sewage pipe 31.

Figure 18:
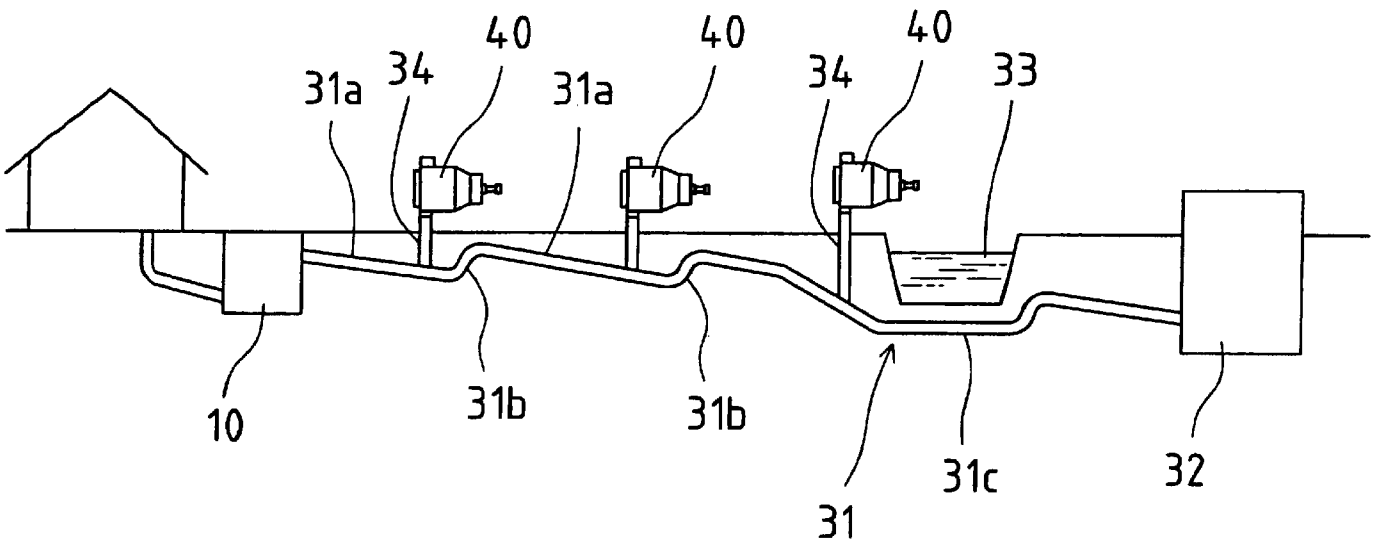
FIG. 18 is a schematic view showing another embodiment of the vacuum-operated sewage system of the present invention.

FIG. 18 schematically shows another embodiment of the vacuum-operated sewage system of the present invention. A plurality of air intake ducts 34 extend upwardly from the vacuum sewage pipe 31 at the downstream areas of the downward slopes 31*a* which correspond to the upstream areas of the upward slopes 31*b* or the diversion 31*c*. The top end of each air intake duct 34 locates above the ground and is equipped with an air inlet valve 40.

Figure 19:
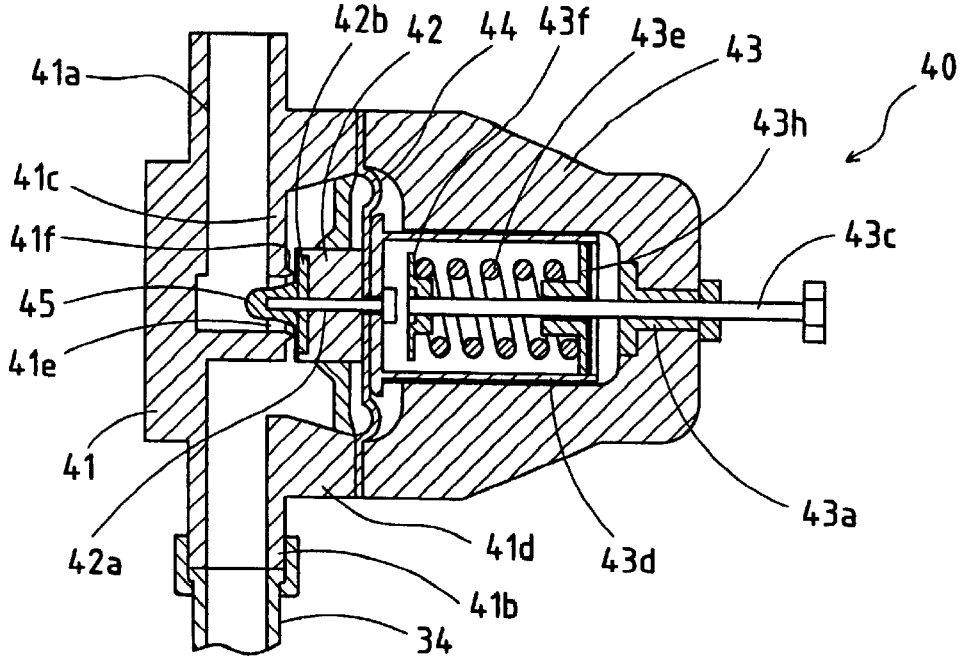
FIG. 19 is a sectional view showing an air inlet valve disposed in the second vacuum-operated sewage system.

FIG. 19 shows, in section, the air inlet valve 40 provided at the top end of each air intake duct 34 coupled to the vacuum sewage pipe 31. The structure of the air inlet valve 40 is substantially the same as that of the above-mentioned air inlet valves 20 provided in the vacuum valve unit 10. The air inlet valve 40 comprises a valve box 41 connected at the top end of the air intake duct 34, a valve member 42 disposed inside the valve box 41, and a cap member 43 attached to the valve box 41.

The valve box 41 includes a cylindrical air exit 41*b* connected to the top end of the air intake duct 34 as well as a cylindrical air entrance 41*a* located concentrically at the opposite end with respect to the air exit 41*b*. The open end of the air entrance 41*a* is exposed to the atmosphere.

The valve box 41 also includes a cylindrical valve housing 41*d* which projects perpendicularly with respect to the air entrance 41*a* and the air exit 41*b* and which communicates with the air exit 41*b*. The hollow frustoconical cap member 43 covers the end opening of the valve housing 41*d* via a diaphragm 44. In the valve box 41, the air entrance 41*a* is separated from the air exit 41*b* and the valve housing 41*d* by a partition 41*c*. The air entrance 41*a* and the valve housing 41*d* are communicable with each other via an air passage 41*e* formed in the partition 41*c* concentrically with respect to the axis of the valve housing 41*d*.

The cylindrical valve housing 41*d* concentrically accommodates the cylindrical valve member 42. One end surface of the valve housing 41*d* is airtightly sealed by the diaphragm 44, on which the hollow cap member 43 is integrally mounted in face-to-face relation with the valve housing 41*d*.

The cap member 43 attached to the valve housing 41*d* includes a nut 43*a* fitted axially in the extreme end away from the valve housing 41*d*. An adjusting bolt 43*c* is screwed through the nut 43*a* and extends along the axis of the cap member 43.

The shaft of the adjusting bolt 43*c* located in the cap member 43 is equipped with a compression spring 43*e*. One end of the compression spring 43*e* is held by a spring holder 43*f* at the end of the adjusting bolt 43*c* on the diaphragm 44 side, and the other end is held by a spring holder 43*h* which is slidable with respect to the adjusting bolt 43*c*. The compression spring 43*e* is accommodated within the cylindrical piston 43*d*, which is stressed away from the air passage 41*e* by the compression spring 43*e*.

Adjacent to the valve housing 41*d*, the bottom surface of the piston 43*d* axially holds the top end of a valve rod 42*a*. The valve rod 42*a* extends through the axial centers of the bottom surface of the piston 43*d*, the diaphragm 44, and the valve member 42 disposed in the valve housing 41*d*. The valve member 42 fitted with the valve rod 42*a* locates opposite to the air passage 41*e* which provides communication between the valve housing 41*d* and the air entrance 41*a* in the valve box 41. A packing 42*b* is equipped at the surface of the valve member 42 opposite to the air passage 41*e*.

The valve rod 42*a* extending through the valve housing 41*d* is inserted into the axial centre of the air passage 41*e*, and a guide member 45 is mounted at the extreme end thereof via the packing 42*b*. With the guide member 45 inserted into the air passage 41*e*, the packing 42*b* can close the air passage 41*e* when pressed against a valve seat 41*f* formed around the periphery of the air passage 41*e* provided in the valve housing 41*d*.

Figure 20:
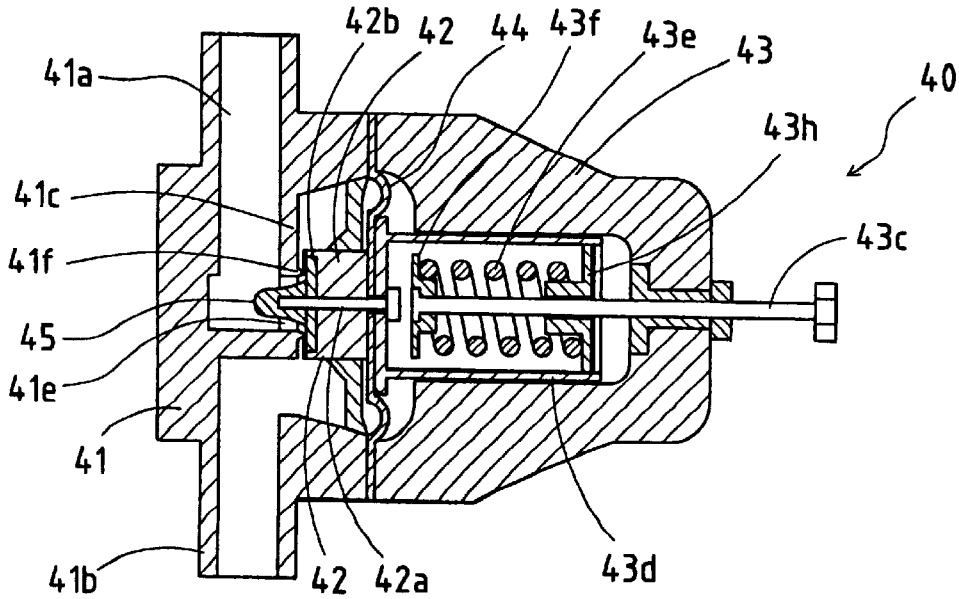
FIG. 20 is a sectional view showing the operation of the air inlet valve shown in FIG. 19.

In the air inlet valve 40, as shown in FIG. 20, the diaphragm 44 is normally sucked by the vacuum inside the vacuum sewage pipe 31 which is communicated with the air inlet valve 40 through the air intake duct 34. The valve member 42 is displaced toward the air passage 41*e* to close the air passage 41*e* with the packing 42*b*.

While sewage is transported in the vacuum sewage pipe 31 with a two-phase air/liquid flow, a water-block is formed at an area slightly downstream of the junction of the vacuum sewage pipe 31 and the air intake duct 34, i.e. a bent defined at the switch area from the downward slope 31*a* to the upward slope 31*b* or the like. The water-block causes the rise of pressure and the drop of the vacuum degree in the vacuum sewage pipe 31 on the upstream side of the water-block. In this state, the spring stress of the compression spring 43*e*, which is greater than the suction force imposed on the diaphragm 44 by the vacuum, allows the valve member 42 to slide away from the air passage 41*e* for the opening thereof, as shown in FIG. 19. As a result, air is allowed in from the air entrance 41*a* through the air passage 41*e*, the valve housing 41*d*, the air exit 41*b* and the air intake duct 34, and finally supplied into the vacuum sewage pipe 31. The thus supplied air clears the water-block formed in the vacuum sewage pipe 31, and thereafter creates a two-phase air/liquid flow to transport sewage downstream.

After the breakthrough of the water-block in the vacuum sewage pipe 31, the degree of vacuum rises on the upstream side of the water-block. The vacuum sucks the diaphragm 44 in the air inlet valve 40 to effect the sliding movement of the valve member 44 toward the air passage 41*e*, thereby to close the air passage 41*e* with the packing 42*b*.

Figure 21:
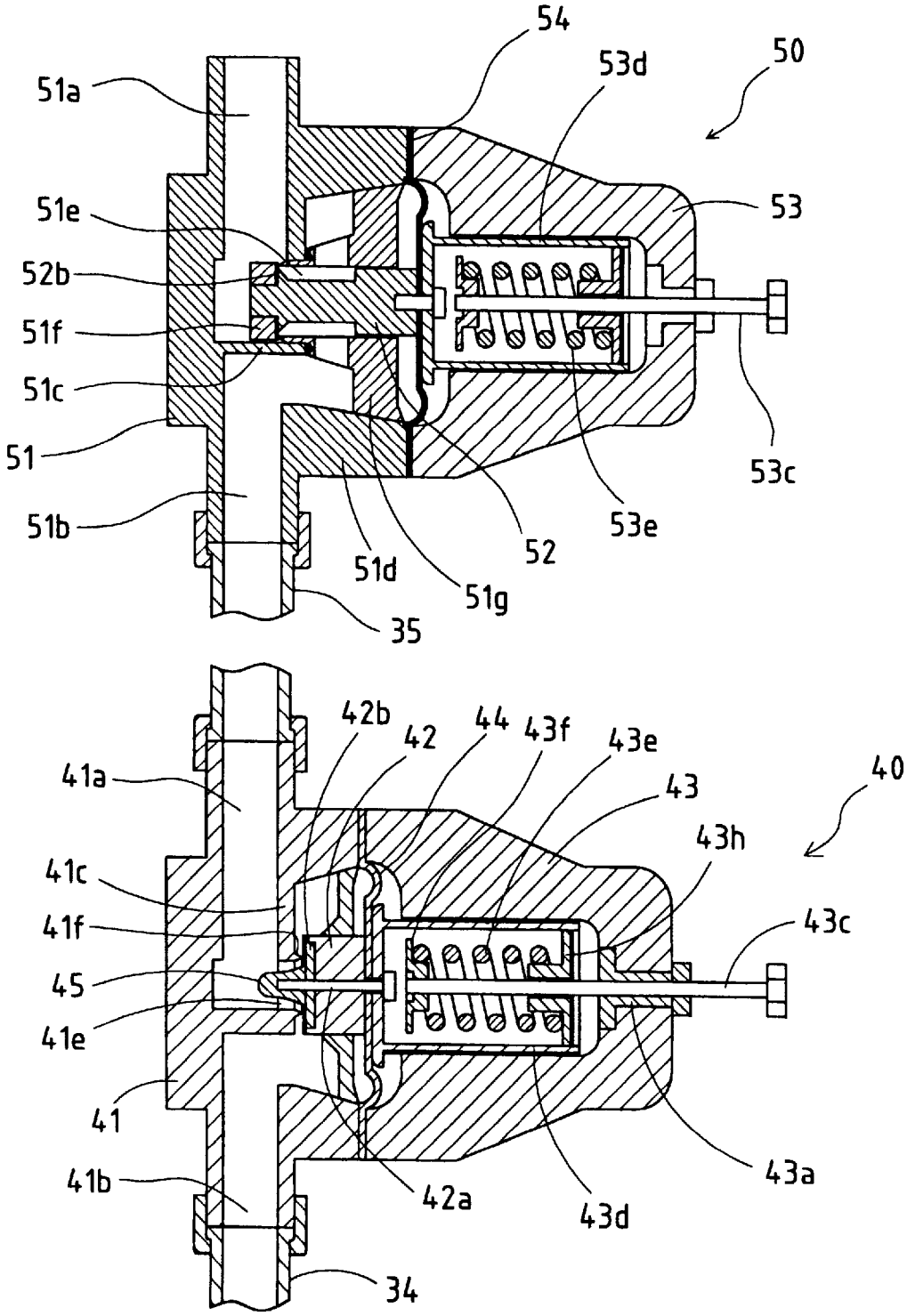
FIG. 21 is a sectional view showing an air intake portion in yet another embodiment of the vacuum-operated sewage system of the present invention.

As shown in FIG. 21, the vacuum-operated sewage system of the second embodiment can be modified to install a second air inlet valve 50 which is connected via a connection pipe 35 to the air entrance end of the first air inlet valve 40 equipped at the top end of the air intake duct 34. The second air inlet valve 50 comprises a valve box 51 including an air entrance 51*a*, an air exit 51*b* and a valve housing 51*d*, and a cap member 53 mounted on the valve housing 51*d* via a diaphragm 54. The air exit 51*b* in the valve box 51 is connected, via the connection pipe 35, to the air entrance 41*a* of the first air inlet valve 40 equipped at the top end of the air intake duct 34.

In the valve box 51, the air entrance 51*a* is separated from the valve housing 51*d* by a partition 51*c*, while the valve housing 51*d* and the air exit 51*b* are communicated with each other. An air passage 51*e* is provided in the partition 51*c* concentrically with the axis of the valve housing 51*d* in order to provide communication between the air entrance 51*a* and the valve housing 51*d*.

The valve housing 51*d* accommodates a cylindrical valve member 52 slidably held by a valve guide 51*g*. The valve member 52 is united with a piston 53*d* housed in the cap member 53 with interposition of the diaphragm 54. The valve guide 51*g* includes a frustoconical portion whose outer diameter gradually diminishes toward the air entrance 51*a* and which is formed concentrically at the axial centre of the valve housing 51*d*, with keeping an appropriate clearance from the inner circumferential surface of the valve housing 51*d*. The tip of the frustoconical portion of the valve guide 51*g* is inserted through the air passage 51*e* and located in the air entrance 51*a*.

The frustoconical portion in the valve guide 51*g* axially forms a hollow part for slidably holding the valve member 52. The distal end of the valve member 52 with respect to the diaphragm 54 is inserted through the frustoconical portion of the valve guide 51*g* and locates inside the air entrance 51*a*. The distal end of the valve member 52 in the air entrance 51*a* is equipped with a packing 52*b* which contacts the tip end of the frustoconical portion of the valve guide 51*g*, which tip end defines a valve seat 51*f* at the periphery of the air passage 51*e*.

The piston 53*d* is accommodated in the cap member 53 which is mounted on the valve member 52 via the diaphragm 54. Similar to the piston 43*d* accommodated in the cap member 43 of the first air inlet valve 40, the piston 53*d* is stressed away from the air passage 51*e* by a compression spring 53*e* wrapped around an adjusting bolt 53*c*. The stress of the compression spring 53*e* is adjusted by rotating the adjusting bolt 53*c*.

In the second air inlet valve 50, the packing 52*b* is normally pressed against the valve seat 51*f* by the spring stress of the compression spring 53*e* to close the air passage 51*e*. In the course of time, a water-block formed in the vacuum sewage pipe 31 likewise causes the rise of the pressure and the drop of the vacuum degree. While the first air inlet valve 40 equipped at the top end of the air intake duct 34 is made open, the degree of vacuum inside the air exit 51*b* and the valve housing 51*d* of the second air inlet valve 50 is brought to the same degree as inside the vacuum sewage pipe 31. Since the diaphragm 54 is sucked into the valve housing 51*d* due to the vacuum, the packing 52*b* of the valve member 52 locating in the air entrance 51*a* slides away from the air passage 51*e* and loses contact with the valve seat 51*f* to open the air passage 51*e*. With the two air inlet valves 40, 50 being open, air is introduced from the air entrance 51*a* to the valve housing 51*d* in the second air inlet valve 50, then transported into the first air inlet valve 40 in the open state and finally supplied to the vacuum sewage pipe 31.

The first air inlet valve 40 equipped at the top end of the air in take duct 34 is closed after the water-block is cleared by supplying air into the vacuum sewage pipe 31. In this connection, the air exit 51*b* in the second air inlet valve 50 is released from the vacuum state, whereby the valve member 52 is displaced by the spring stress of the compression spring 53*e* to close the air passage 51*e*.

In case a trouble in the vacuum-operated sewage system such as breakage of the vacuum sewage pipe 31 results in the rise of the pressure and the drop of the degree of vacuum therein, the sewage system of the third embodiment opens both the first air inlet valve 40 equipped at the top end of each air intake duct 34 and the second air inlet valve 50. During the shutdown of the vacuum pump, the pressure in the vacuum sewage pipe 31 rises almost to the atmospheric pressure. The diaphragm 54 which no longer receives pressure from the vacuum sewage pipe 31 is deformed by the spring stress of the compression spring 53*e* in the direction distant from the air passage 51*e*, whereby the packing 52*b* equipped at the valve member 52 closes the air passage 51*e*.

For the restart of the vacuum-operated sewage system after the recovery from the trouble, the inside of the vacuum sewage pipe 31 is brought back to the normal vacuum state by operating the vacuum pump. Since the second air inlet valve 50 remains closed during the shutdown of the vacuum pump, the vacuum sewage pipe 31, which has been kept in an airtight state before the restart of the vacuum pump, can recover the normal vacuum state quickly.

According to this embodiment, the second air inlet valve 50 is kept closed, while the degree of vacuum drops in the vacuum sewage pipe 31 and the pressure therein rises almost to the atmospheric pressure. As a result, for the restart of the vacuum-operated sewage system after the recovery from a trouble such as breakage of the vacuum sewage pipe 31, the vacuum sewage pipe 31 can be quickly brought back to the normal vacuum state without a manual closure of the air entrance 21*a* of the first inlet valve 40.

What is claimed is:

1. A vacuum-operated sewage system for transporting sewage in the form of a two-phase air/liquid flow comprising air and sewage which flows through a vacuum sewage pipe evacuated inside to a vacuum state, wherein a first air inlet valve is disposed in the neighbourhood of and upstream of a potential water-block formation area in the vacuum sewage pipe so as to supply air from above the ground to the area, and the first air inlet valve is allowed to open when a degree of vacuum drops in the vacuum sewage pipe; and wherein a second air inlet valve is connected to the first air inlet valve and subjected to a pressure inside the vacuum sewage pipe transmitted through the first air inlet valve in an open state, and the second air inlet valve is allowed to open when a degree of vacuum drops in the vacuum sewage pipe thereby to supply air thereto via the first air inlet valve, and allowed to close when the degree of vacuum in the vacuum sewage pipe drops as far as a predetermined degree.

2. An air inlet valve which is employed as a second air inlet valve in a vacuum-operated sewage system for transporting sewage, with use of two air inlet valves, in the form of a two-phase air/liquid flow comprising air and sewage which flows through a vacuum sewage pipe evacuated inside to a vacuum state, a first air inlet valve being disposed in the neighborhood of and upstream of a potential water-block formation area in the vacuum sewage pipe so as to supply air from above the ground to the area, wherein a second air inlet valve is connected to the first air inlet valve and subjected to a pressure inside the vacuum sewage pipe transmitted through the first air inlet valve in an open state, wherein the second air inlet valve is allowed to open when a degree of vacuum drops in the vacuum sewage pipe thereby to supply air thereto via the first air inlet valve, and allowed to close when the degree of vacuum in the vacuum sewage pipe drops as far as a predetermined degree, and wherein the second air inlet valve comprises:

a valve box having an air passage for passing the air;

a diaphragm attached to the valve box and sucked therein by the vacuum in the vacuum sewage pipe;

a valve member disposed in the valve box and allowed by the diaphragm sucked into the valve box to open the air passage; and a stressing means for stressing the valve member to close the air passage.

3. A vacuum-operated sewage system comprising a vacuum sewage pipe evacuated inside to a vacuum state, and a vacuum valve operated by the vacuum in the vacuum sewage pipe and connecting the vacuum sewage pipe to a sewage pipe, whereby sewage accumulated in a sewage tank is sucked through the sewage suction pipe into the vacuum sewage pipe while the vacuum valve is open, an inlet valve connected in the neighborhood of the valve and between the vacuum valve and the vacuum sewage pipe is allowed to close by the vacuum in the vacuum sewage pipe, and to open and supply air into the vacuum sewage pipe when a degree of vacuum drops therein;

the air inlet valve comprising a valve box having an air passage for passing the air, a diaphragm attached to the valve box and sucked therein by the vacuum in the vacuum sewage pipe, a valve member disposed in the valve box and operated by the diaphragm sucked into the valve box to close the air passage, a stressing means for adjustably stressing the air inlet valve to open the air passage;

wherein displacement of the valve member provided in the air inlet valve is controlled when the degree of vacuum in the vacuum sewage pipe drops as far as a predetermined degree, so that the valve member provided in the air inlet valve closes the air passage when the degree of vacuum in the vacuum sewage pipe drops as far as a predetermined degree, and wherein the valve member provided in the air inlet valve maximizes an amount of air flowing through the air passage immediately after the air passage is opened, gradually decreases the amount of air flowing through the air passage is correspondence with a drop of the degree of vacuum in the vacuum sewage pipe, and closes the air passage when the degree of vacuum in the vacuum sewage pipe drops as far as a predetermined degree.

4. A vacuum-operated sewage system comprising a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open, an air inlet valve connected in the neighborhood of the vacuum valve and between the vacuum valve and vacuum sewage pipe is allowed to close by the vacuum in the vacuum sewage pipe, and to open and supply air into the vacuum sewage pipe when a degree of vacuum drops therein;

the air inlet valve comprising a valve box having an air passage for passing the air, a diaphragm attached to the valve box and sucked therein by the vacuum in the vacuum sewage pipe, a valve member disposed in the valve box and operated by the diaphragm sucked into the valve box to close the air passage, and a stressing means for stressing the valve member to open the air passage;

wherein the valve member provided in the air inlet valve maximizes and amount of air flowing through the air passage immediately after the air passage is opened, gradually decreases the amount of air flowing through the air passage in correspondence with a drop of the degree of vacuum in the vacuum sewage pipe, and closes the air passage when the degree of vacuum in the vacuum sewage pipe drops as far as a predetermined degree;

said valve member being displaceable in the valve box to open and close the air passage, a piston member being integrated with the valve member and displaceable in directions of opening and closing the air passage by the vacuum in the vacuum sewage pipe, and said stressing means being operative for stressing the piston member such that the valve member opens the air passage; and wherein displacement of the valve member provided in the air inlet valve is controlled when the degree of vacuum in the vacuum sewage pipe drops as far as a predetermined degree.

5. A vacuum-operated sewage system for transporting sewage in the form of a two phase air/liquid flow comprising air and sewage which flows through a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open, an air inlet valve connected in the neighborhood of the vacuum valve and between the vacuum valve and vacuum sewage pipe is allowed to close by the vacuum in the vacuum sewage pipe, and to open and supply air into the vacuum sewage pipe when a degree of vacuum drops therein;

the air inlet valve comprising a valve box having an air passage for passing the air, a diaphragm attached to the valve box and sucked therein by the vacuum in the vacuum sewage pipe, a valve member disposed in the valve box and operated by the diaphragm sucked into the valve box to close the air passage, a stressing means for adjustably stressing the air inlet valve to open the air passage;

wherein displacement of the valve member provided in the air inlet valve is controlled when the degree of vacuum in the vacuum sewage pipe drops as far as a predetermined degree, so that the valve member provided in the air inlet valve closes the air passage when the degree of vacuum in the vacuum sewage pipe drops as far as a predetermined degree;

wherein the air inlet valve is disposed in the neighborhood of and upstream of a potential water-block formation area in the vacuum sewage pipe so as to supply air from above the ground to the area.

6. An air inlet valve which is employed in a vacuum-operated sewage system comprising a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open, wherein the air inlet valve is disposed in the neighborhood of the vacuum valve and between the vacuum valve and the vacuum sewage pipe, and is allowed to close by the vacuum in the vacuum sewage pipe and to open and supply air into the vacuum sewage pipe when a degree of vacuum drops therein, and wherein the air inlet valve comprises:

a valve box having an air passage for passing the air;

a diaphragm attached to the valve box and sucked therein by the vacuum in the vacuum sewage pipe;

a valve member disposed in the valve box and allowed by the diaphragm sucked into the valve box to close the air passage;

a stressing means for stressing the valve member to open the air passage, wherein a force of the stressing means is adjustable, wherein displacement of the valve member is controlled when the degree of vacuum in the vacuum sewage pipe drops as far as a predetermined degree, wherein the valve member closes the air passage when the degree of vacuum in the vacuum sewage pipe drops as far as a predetermined degree, and wherein the valve member gradually increases the amount of air flowing through the air passage in correspondence with a drop of the degree of vacuum in the vacuum sewage pipe, and closes the air passage when the degree of vacuum in the vacuum sewage pipe drops as far as a predetermined degree.

7. An air inlet valve which is employed in a vacuum-operated sewage system comprising a vacuum sewage pipe evacuated inside to a vacuum state, and a vacuum valve operated by the vacuum in the vacuum sewage pipe and connecting the vacuum sewage pipe to a sewage suction pipe, whereby sewage accumulated in a sewage tank is sucked through the sewage suction pipe into the vacuum sewage pipe while the vacuum valve is open, wherein the air inlet valve is disposed in the neighborhood of the vacuum valve and between the vacuum valve and the vacuum sewage pipe, and is allowed to close by the vacuum in the vacuum sewage pipe and to open and supply air into the vacuum sewage pipe when a degree of vacuum drops therein, and wherein the air inlet valve comprises:

a valve box having an air passage for passing the air;

a diaphragm attached to the valve box and sucked therein by the vacuum in the vacuum sewage pipe;

a valve member disposed in the valve box and allowed by the diaphragm sucked into the valve box to close the air passage;

a piston member being integrated with the valve member and displaceable in directions of opening and closing the air passage by the vacuum in the vacuum sewage pipe;

a stressing means for stressing the piston member such that the valve member opens in the air passage, wherein the valve member gradually increases the amount of air flowing through the air passage in correspondence with a drop of the degree of vacuum in the vacuum sewage pipe, and closes the air passage when the degree of vacuum in the vacuum sewage pipe drops as far as a predetermined degree, and wherein displacement of the valve member is controlled when the degree of vacuum in the vacuum sewage pipe drops as far as a predetermined degree.

* * * * *